US008905833B2

(12) United States Patent
Basallo et al.

(10) Patent No.: US 8,905,833 B2
(45) Date of Patent: Dec. 9, 2014

(54) GAMING SYSTEM AND METHOD FOR PROVIDING A MATCHING SYMBOLS GAME

(71) Applicant: IGT, Reno, NV (US)

(72) Inventors: Leandro Basallo, San Francisco, CA (US); Scott A. Caputo, Santa Clara, CA (US)

(73) Assignee: IGT, Las Vegas, NV (US)

( * ) Notice: Subject to any disclaimer, the term of this patent is extended or adjusted under 35 U.S.C. 154(b) by 155 days.

(21) Appl. No.: 13/787,619

(22) Filed: Mar. 6, 2013

(65) Prior Publication Data

US 2014/0256401 A1 Sep. 11, 2014

(51) Int. Cl.
*A63F 1/00* (2006.01)
*G07F 17/32* (2006.01)

(52) U.S. Cl.
CPC ..... *G07F 17/3293* (2013.01)
USPC ..... 463/16; 463/17; 463/18

(58) Field of Classification Search
CPC ..... A63F 2300/10; A63F 2300/1018; A63F 2300/30; A63F 2300/405; A63F 2300/407; A63F 2300/50; A63F 2300/60; A63F 2300/6027
USPC ..... 463/16–18
See application file for complete search history.

(56) References Cited

U.S. PATENT DOCUMENTS 4,448,419 A 5/1984 Telnaes
4,508,353 A 4/1985 Meyer et al.
4,624,459 A 11/1986 Kaufman
4,695,053 A 9/1987 Vazquez, Jr. et al.
4,732,386 A 3/1988 Rayffel
4,775,155 A 10/1988 Lees
5,072,946 A 12/1991 Miller
5,205,555 A 4/1993 Hamano
5,294,128 A 3/1994 Marquez
5,324,041 A 6/1994 Boylan et al.
5,342,047 A 8/1994 Heidel et al.
5,423,539 A 6/1995 Nagao
5,431,407 A 7/1995 Hofberg et al.
5,449,173 A 9/1995 Thomas et al.
5,511,781 A 4/1996 Wood et al.
5,531,441 A 7/1996 Dabrowski et al.
5,536,016 A 7/1996 Thompson
5,542,669 A 8/1996 Charron et al.

(Continued)

FOREIGN PATENT DOCUMENTS

EP 333338 9/1989
EP 0874337 10/1998

(Continued)

*Primary Examiner* — Damon Pierce
*Assistant Examiner* — Jeffrey Wong
(74) *Attorney, Agent, or Firm* — Neal, Gerber & Eisenberg LLP

(57) ABSTRACT

In various embodiments, the gaming system enables a player to select one or more playing cards from a plurality of playing cards, wherein different playing cards include or are otherwise associated with one or more different symbols. The gaming system then determines if any matches occur amongst the plurality of symbols of a plurality of playing cards (including at least the player's selected playing card(s)). Following such a determination, the gaming system determines and provides zero, one or more awards based on one or more of: (i) which, if any, matching symbols occurred amongst the plurality of symbols of the plurality of playing cards, and (ii) a quantity of symbol matches which occurred amongst the plurality of symbols of the plurality of playing cards.

24 Claims, 15 Drawing Sheets

(56) References Cited

U.S. PATENT DOCUMENTS

| | | | |
|---|---|---|---|
| 5,560,603 | A | 10/1996 | Seelig et al. |
| 5,607,162 | A | 3/1997 | Boylan et al. |
| 5,611,535 | A | 3/1997 | Tiberio |
| 5,692,755 | A | 12/1997 | Gutierrez |
| 5,722,891 | A | 3/1998 | Inoue |
| 5,766,074 | A | 6/1998 | Cannon et al. |
| 5,769,716 | A | 6/1998 | Saffari et al. |
| 5,772,509 | A | 6/1998 | Weiss |
| 5,788,573 | A | 8/1998 | Baerlocher et al. |
| 5,823,874 | A | 10/1998 | Adams |
| 5,833,536 | A | 11/1998 | Davids et al. |
| 5,848,932 | A | 12/1998 | Adams |
| 5,851,148 | A | 12/1998 | Brune et al. |
| 5,873,781 | A | 2/1999 | Keane |
| 5,882,261 | A | 3/1999 | Adams |
| 5,911,418 | A | 6/1999 | Adams |
| 5,918,884 | A | 7/1999 | Di Muro |
| 5,919,091 | A | 7/1999 | Bell et al. |
| 5,935,002 | A | 8/1999 | Falciglia |
| 5,944,314 | A | 8/1999 | Stavinsky |
| 5,947,820 | A | 9/1999 | Morro et al. |
| 5,951,397 | A | 9/1999 | Dickinson |
| 5,964,463 | A | 10/1999 | Moore, Jr. |
| 5,980,384 | A | 11/1999 | Barrie |
| 5,984,781 | A | 11/1999 | Sunaga |
| 5,988,643 | A | 11/1999 | Awada |
| 5,989,121 | A | 11/1999 | Sakamoto |
| 5,996,997 | A | 12/1999 | Kamille |
| 5,997,400 | A | 12/1999 | Seelig et al. |
| 6,004,207 | A | 12/1999 | Wilson, Jr. et al. |
| 6,015,346 | A | 1/2000 | Bennett |
| 6,033,307 | A | 3/2000 | Vancura |
| 6,056,642 | A | 5/2000 | Bennett |
| 6,059,289 | A | 5/2000 | Vancura |
| 6,059,658 | A | 5/2000 | Mangano et al. |
| 6,067,438 | A | 5/2000 | Chen et al. |
| RE36,739 | E | 6/2000 | Gutierrez |
| 6,089,976 | A | 7/2000 | Schneider et al. |
| 6,089,977 | A | 7/2000 | Bennett |
| 6,102,403 | A | 8/2000 | Kaufman |
| 6,102,798 | A | 8/2000 | Bennett |
| 6,105,962 | A | 8/2000 | Malavazos et al. |
| 6,120,031 | A | 9/2000 | Adams |
| 6,126,542 | A | 10/2000 | Fier |
| 6,126,547 | A | 10/2000 | Ishimoto |
| 6,129,355 | A | 10/2000 | Hahn et al. |
| 6,135,885 | A | 10/2000 | Lermusiaux |
| 6,142,873 | A | 11/2000 | Weiss et al. |
| 6,149,521 | A | 11/2000 | Sanduski |
| 6,155,925 | A | 12/2000 | Giobbi et al. |
| 6,159,095 | A | 12/2000 | Frohm et al. |
| 6,159,097 | A | 12/2000 | Gura |
| 6,159,098 | A | 12/2000 | Slomiany et al. |
| 6,162,121 | A | 12/2000 | Morro et al. |
| 6,164,652 | A | 12/2000 | Lauretta et al. |
| 6,168,520 | B1 | 1/2001 | Baerlocher et al. |
| 6,168,523 | B1 | 1/2001 | Piechowiak et al. |
| 6,173,955 | B1 | 1/2001 | Perrie et al. |
| 6,174,234 | B1 | 1/2001 | Seibert, Jr. et al. |
| 6,174,235 | B1 | 1/2001 | Walker et al. |
| 6,190,255 | B1 | 2/2001 | Thomas et al. |
| 6,196,548 | B1 | 3/2001 | Schaefer |
| 6,203,429 | B1 | 3/2001 | Demar et al. |
| 6,224,483 | B1 | 5/2001 | Mayeroff |
| 6,227,969 | B1 | 5/2001 | Yoseloff |
| 6,227,971 | B1 | 5/2001 | Weiss |
| 6,231,442 | B1 | 5/2001 | Mayeroff |
| 6,231,445 | B1 | 5/2001 | Acres |
| 6,234,897 | B1 | 5/2001 | Frohm et al. |
| 6,261,177 | B1 | 7/2001 | Bennett |
| 6,270,409 | B1 | 8/2001 | Shuster |
| 6,287,197 | B1 | 9/2001 | Dickinson et al. |
| 6,299,165 | B1 | 10/2001 | Nagano |
| 6,305,686 | B1 | 10/2001 | Perrie et al. |
| 6,309,300 | B1 | 10/2001 | Glavich |
| 6,312,334 | B1 | 11/2001 | Yoseloff |
| 6,315,660 | B1 | 11/2001 | DeMar et al. |
| 6,315,663 | B1 | 11/2001 | Sakamoto |
| 6,315,664 | B1 | 11/2001 | Baerlocher et al. |
| 6,328,649 | B1 | 12/2001 | Randall et al. |
| 6,334,814 | B1 | 1/2002 | Adams |
| 6,336,860 | B1 | 1/2002 | Webb |
| 6,346,043 | B1 | 2/2002 | Colin et al. |
| 6,347,996 | B1 | 2/2002 | Gilmore et al. |
| 6,398,218 | B1 | 6/2002 | Vancura |
| 6,398,644 | B1 | 6/2002 | Perrie et al. |
| 6,413,160 | B1 | 7/2002 | Vancura |
| 6,435,511 | B1 | 8/2002 | Vancura et al. |
| 6,439,573 | B1 | 8/2002 | Sklar |
| 6,554,703 | B1 | 4/2003 | Bussick et al. |
| 6,561,902 | B1 | 5/2003 | Walker et al. |
| 6,572,471 | B1 | 6/2003 | Bennett |
| 6,592,457 | B1 | 7/2003 | Frohm et al. |
| 6,607,438 | B2 | 8/2003 | Baerlocher et al. |
| 6,632,139 | B1 | 10/2003 | Baerlocher |
| 6,669,559 | B1 | 12/2003 | Baerlocher et al. |
| 6,746,328 | B2 | 6/2004 | Cannon et al. |
| 6,749,502 | B2 | 6/2004 | Baerlocher |
| 6,758,747 | B2 | 7/2004 | Baerlocher |
| 6,855,053 | B2 | 2/2005 | Baerlocher |
| 6,939,229 | B2 | 9/2005 | McClintic |
| 6,964,416 | B2 | 11/2005 | McClintic et al. |
| 7,040,983 | B2 | 5/2006 | Dolloff et al. |
| 7,056,192 | B2 | 6/2006 | Venigalla et al. |
| 7,128,646 | B2 | 10/2006 | Baerlocher et al. |
| 7,198,570 | B2 | 4/2007 | Rodgers et al. |
| 7,252,591 | B2 | 8/2007 | Van Asdale |
| 7,396,279 | B2 | 7/2008 | Berman |
| 7,399,226 | B2 | 7/2008 | Mishra |
| 7,448,948 | B2 | 11/2008 | Hughs-Baird et al. |
| 7,575,515 | B2 | 8/2009 | Rodgers et al. |
| 7,874,908 | B2 | 1/2011 | Walker et al. |
| 2002/0025847 | A1 | 2/2002 | Thomas et al. |
| 2002/0034974 | A1 | 3/2002 | Wood et al. |
| 2002/0142822 | A1 | 10/2002 | Baerlocher et al. |
| 2002/0142823 | A1 | 10/2002 | DeMar et al. |
| 2002/0151341 | A1 | 10/2002 | Baerlocher et al. |
| 2002/0151357 | A1 | 10/2002 | Acres |
| 2002/0155873 | A1 | 10/2002 | Berman et al. |
| 2002/0155883 | A1 | 10/2002 | Baerlocher |
| 2002/0165019 | A1 | 11/2002 | Slomiany |
| 2003/0104852 | A1 | 6/2003 | Duhamel |
| 2006/0252485 | A1* | 11/2006 | Baerlocher et al. ..... 463/16 |
| 2008/0272541 | A1 | 11/2008 | Walker et al. |

FOREIGN PATENT DOCUMENTS

| | | |
|---|---|---|
| EP | 0945837 | 9/1999 |
| EP | 0984408 | 3/2000 |
| GB | 2117155 | 10/1983 |
| GB | 2262642 | 6/1993 |
| GB | 2335524 | 9/1999 |
| GB | 2393021 | 3/2004 |
| GB | 2396566 | 6/2004 |
| WO | PCT/AU9700/000121 | 9/1997 |
| WO | WO/97/32285 | 9/1997 |
| WO | WO/00/12186 | 3/2000 |
| WO | WO 00/16866 | 3/2000 |

* cited by examiner

| Paytable | |
|---|---|
| Matching Symbol | Award |
| Each Matching | 150 |
| Each Matching | 50 |
| Each Matching | 75 |

| Paytable | |
|---|---|
| Matching Symbol | Award |
| Each Matching | 150 |
| Each Matching | 50 |
| Each Matching | 75 |

| Paytable | |
|---|---|
| Matching Symbol | Award |
| Each Matching | 150 |
| Each Matching | 50 |
| Each Matching | 75 |

| Paytable | |
|---|---|
| Matching Symbol | Award |
| Each Matching | 150 |
| Each Matching | 50 |
| Each Matching | 75 |

| Paytable | |
|---|---|
| Matching Symbol | Award |
| Each Matching | 150 |
| Each Matching | 100 |

| Paytable | |
|---|---|
| Matching Symbol | Award |
| Each Matching | 150 |
| Each Matching | 100 |

FIG. 2J

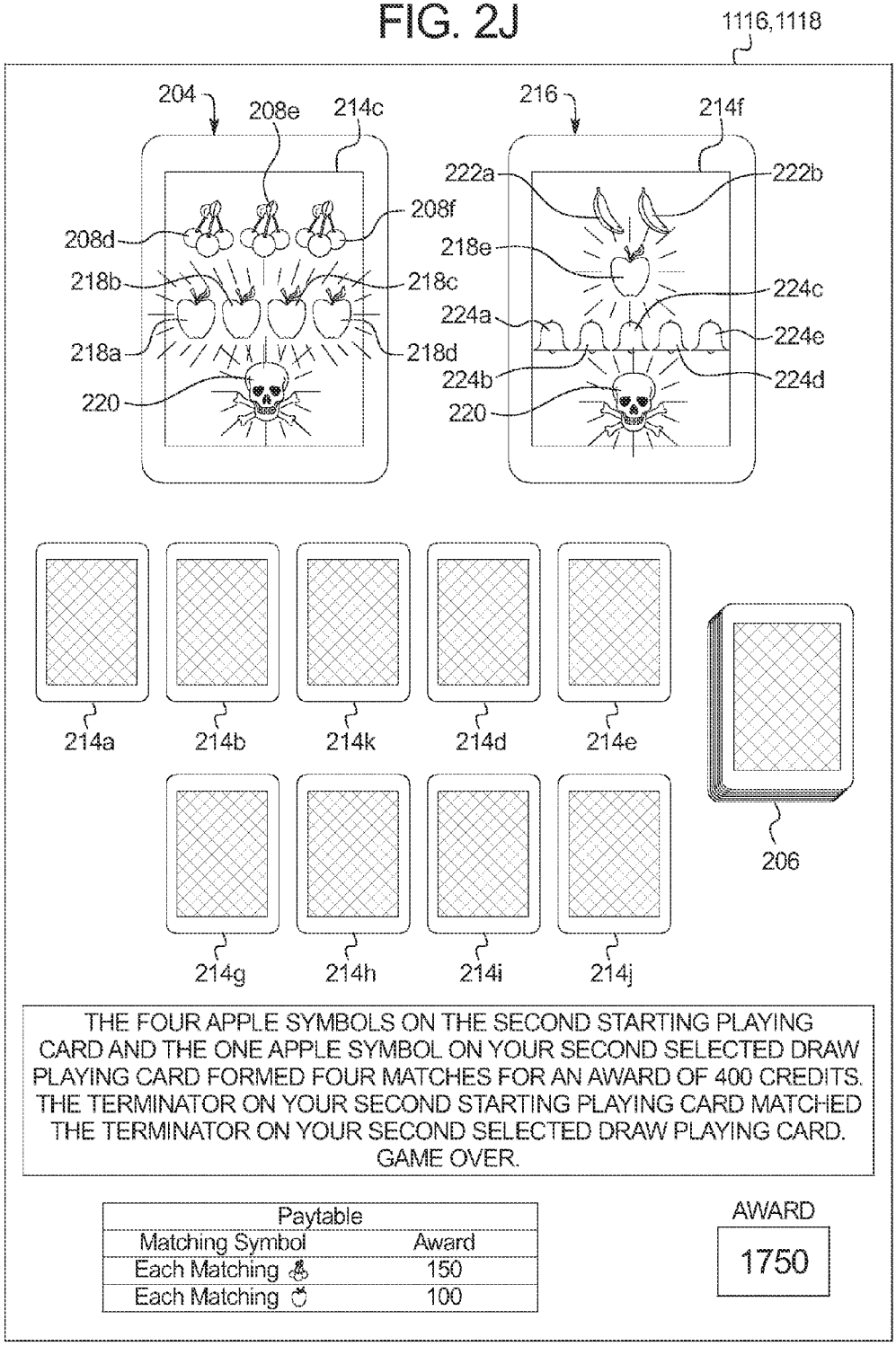

THE FOUR APPLE SYMBOLS ON THE SECOND STARTING PLAYING CARD AND THE ONE APPLE SYMBOL ON YOUR SECOND SELECTED DRAW PLAYING CARD FORMED FOUR MATCHES FOR AN AWARD OF 400 CREDITS. THE TERMINATOR ON YOUR SECOND STARTING PLAYING CARD MATCHED THE TERMINATOR ON YOUR SECOND SELECTED DRAW PLAYING CARD. GAME OVER.

| Paytable | |
|---|---|
| Matching Symbol | Award |
| Each Matching | 150 |
| Each Matching | 100 |

AWARD

1750

GAMING SYSTEM AND METHOD FOR PROVIDING A MATCHING SYMBOLS GAME

COPYRIGHT NOTICE

A portion of the disclosure of this patent document contains material which is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Generally, symbols or symbol combinations which are less likely to occur provide higher awards. In such known gaming machines, the amount of the wager made on the base game by the player can vary.

Secondary or bonus games are also known in gaming machines. The secondary or bonus games usually provide an additional award to the player. Secondary or bonus games usually do not require an additional wager by the player to be activated. Certain secondary or bonus games are activated or hit upon an occurrence of a designated triggering symbol or triggering symbol combination in the primary or base game. For instance, a bonus symbol occurring on the payline on the third reel of a three reel slot machine may hit the secondary bonus game. Part of the enjoyment and excitement of playing certain gaming machines is the occurrence or triggering of the secondary or bonus game (even before the player knows how much the bonus award will be).

Gaming device manufacturers strive to make gaming devices that provide as much enjoyment and excitement as possible. Players are also attracted to gaming devices that provide new game schemes and interactive features including different ways of determining awards associated with winning symbol combinations or different types of triggering events. Therefore, to increase player enjoyment and excitement, it is desirable to provide players with new game schemes and features for gaming devices which include new and different ways of evaluating generated symbols. A continuing need thus exists to provide new and exciting gaming systems, devices, and methods.

SUMMARY

In various embodiments, the present disclosure relates generally to gaming systems and methods for providing a matching symbols game. In certain embodiments, the gaming system enables a player to select one or more playing cards from a plurality of playing cards, wherein different playing cards include or are otherwise associated with one or more different symbols. The gaming system then determines if any matches occur amongst the plurality of symbols of a plurality of playing cards (including at least the player's selected playing card(s)). Following such a determination, the gaming system determines and provides zero, one or more awards based on one or more of: (i) which, if any, matching symbols occurred amongst the plurality of symbols of the plurality of playing cards, and (ii) a quantity of symbol matches which occurred amongst the plurality of symbols of the plurality of playing cards. Such a configuration of enabling a player to pick one or more playing cards and subsequently determining if zero, one or more awards are provided to the player based on zero, one or more symbol matches amongst at least the player picked card(s) increases the level of excitement and enjoyment of certain players. That is, certain players enjoy the interaction of selecting one or more playing cards knowing that the quantity of symbol matches the player obtains (and thus any award provided to the player) is at least partially based on which playing cards the player selected.

More specifically, in operation of certain embodiments, upon an initiation of the matching symbols game disclosed herein, the gaming system causes a selection of a playing card (i.e., a starting or comparison playing card) from a deck or set of playing cards. Each of the playing cards of the deck or set of playing cards includes one or more of a plurality of symbols, wherein: (i) zero, one or more of the playing cards each include a plurality of the same symbol, and (ii) zero, one or more of the playing cards each include a plurality of different symbols. It should be appreciated that in certain embodiments, the configuration of different symbols included or otherwise associated with different playing cards provides that any two playing cards include at least one pair of matching symbols between them.

In addition to including one or more symbols, a plurality of the playing cards of the deck or set of playing cards each include one or more terminators. Such a configuration provides that the symbols of each of the playing cards form a distinct set of symbols.

Following the selection of the starting playing card and the display of each of the symbols of the starting playing card, the gaming system randomly selects a plurality of previously unselected playing cards from the deck or set of playing cards. This randomly selected plurality of playing cards forms a sub-set of playing cards. While masking or otherwise not displaying the symbols of each of the playing cards in the formed sub-set of playing cards, the gaming system enables the player to pick one of the playing cards (i.e., a player selected draw playing card) from the sub-set of playing cards. That is, the gaming system enables the player to pick a face-down playing card from a randomly selected sub-set of the deck of playing cards.

After the selection of the draw playing card and a subsequent display of the symbols of the draw playing card, the gaming system determines which symbols on the starting playing card match which symbols on the player selected draw playing card. The gaming system then provides the player zero, one or more awards wherein which awards provided to the player are based on: (i) which matching symbols occurred on both the starting playing card and the player selected draw playing card, and (ii) a quantity of matching symbols between the starting playing card and the player selected draw playing card.

In one embodiment, the same symbol may be involved in a plurality of different matches between the starting playing card and the player selected draw playing card. That is, each match between a symbol of the starting playing card and a plurality of symbols of the player selected draw playing card is considered a separate match. For example, if the starting playing card includes two crown symbols and the player selected draw playing card also includes four crown symbols, the gaming system determines that eight crown symbol matches occurred between the starting playing card and the player selected draw playing card. In this example, after determining that an award of one-hundred credits is associated with a pair of matching crown symbols, the gaming system modifies this award of one-hundred credits by eight (i.e., the quantity of crown symbol matches between the starting playing card and the player selected draw playing card) and provides the player an award of eight-hundred credits.

In addition to determining any awards based on any symbol matches, the gaming system determines if the starting playing card and the player selected draw playing card have any matching or corresponding terminators. If the gaming system determines that the starting playing card and the player selected draw playing card have matching or corresponding terminators, the gaming system terminates the play of the matching symbols game. That is, the matching of two terminators between the starting playing card and the player selected draw playing card causes an end of the matching symbols game.

On the other hand, if the gaming system determines that the starting playing card and the player selected draw playing card do not have matching or corresponding terminators, the gaming system discards the starting playing card and reclassifies the player selected draw playing card as the starting playing card. The gaming system then randomly selects a previously unselected playing card from the deck or set of playing cards and adds this selected playing card to the previously formed sub-set of playing cards. In other words, the gaming system replaces the previous player selected draw playing card (now reclassified as the starting playing card) with another playing card randomly selected from the deck of playing cards to reform or recomplete the sub-set of playing cards.

Following the reformation of the sub-set of playing cards (i.e., the replacement of the previously player selected draw playing card with a subsequently selected playing card) and while still masking the symbols of each of the playing cards in the reformed sub-set of playing cards, the gaming system enables the player to pick one of the playing cards (i.e., a new draw playing card) from the sub-set of playing cards. Put differently, the gaming system enables the player to select another draw playing card for the next round of the matching symbols game.

The gaming system then proceeds as described above with determining any matches between the starting playing card (i.e., the former draw playing card) and the newly selected draw playing card. This process continues until either a terminator match occurs between a starting playing card and a player selected draw playing card (i.e., a matching symbols game termination event) or no previously unselected playing cards remain in the deck or set of playing cards (i.e., the player has advanced to and completed the final round of the matching symbols game).

Such configurations provide, for certain players, an increased amount of anticipation associated with picking one or more playing cards knowing that the symbols of the player picked draw playing cards determine the amount of the award provided to the player and when the matching symbols game will end. Such configurations further provide an increased level of excitement and enjoyment for certain players because one or more playing cards selected by a player are utilized in a plurality of symbol matching comparisons and thus utilized in a plurality of different award determinations Additional features and advantages are described in, and will be apparent from, the following Detailed Description and the figures.

BRIEF DESCRIPTION OF THE FIGURES

FIGS. 2A, 2B, 2C, 2D, 2E, 2F, 2G, 2H, 2I and 2J are front views of one embodiment of the gaming system disclosed herein illustrating an example play of a matching symbols game.

DETAILED DESCRIPTION

Matching Symbols

In various embodiments, the gaming system disclosed herein provides a matching symbols game which utilizes a plurality of playing cards each including a plurality of symbols. In certain embodiments, the gaming system enables a player to select one or more playing cards from a plurality of playing cards, wherein different playing cards include or are otherwise associated with one or more different symbols. The gaming system then determines if any matches occur amongst the plurality of symbols of a plurality of playing cards (including at least the player's selected playing card(s)). Following such a determination, the gaming system determines and provides zero, one or more awards based on one or more of: (i) which, if any, matching symbols occurred amongst the plurality of symbols of the plurality of playing cards, and (ii) a quantity of symbol matches which occurred amongst the plurality of symbols of the plurality of playing cards.

While the embodiments described below are directed to a secondary or bonus game, it should be appreciated that the present disclosure may additionally or alternatively be employed in association with a primary or base game. Moreover, while the player's credit balance, the player's wager, and any awards are displayed as an amount of monetary credits or currency in certain of the embodiments described below, one or more of such player's credit balance, such player's wager, and any awards provided to such a player may be for non-monetary credits, promotional credits, and/or player tracking points or credits.

Figure 1:
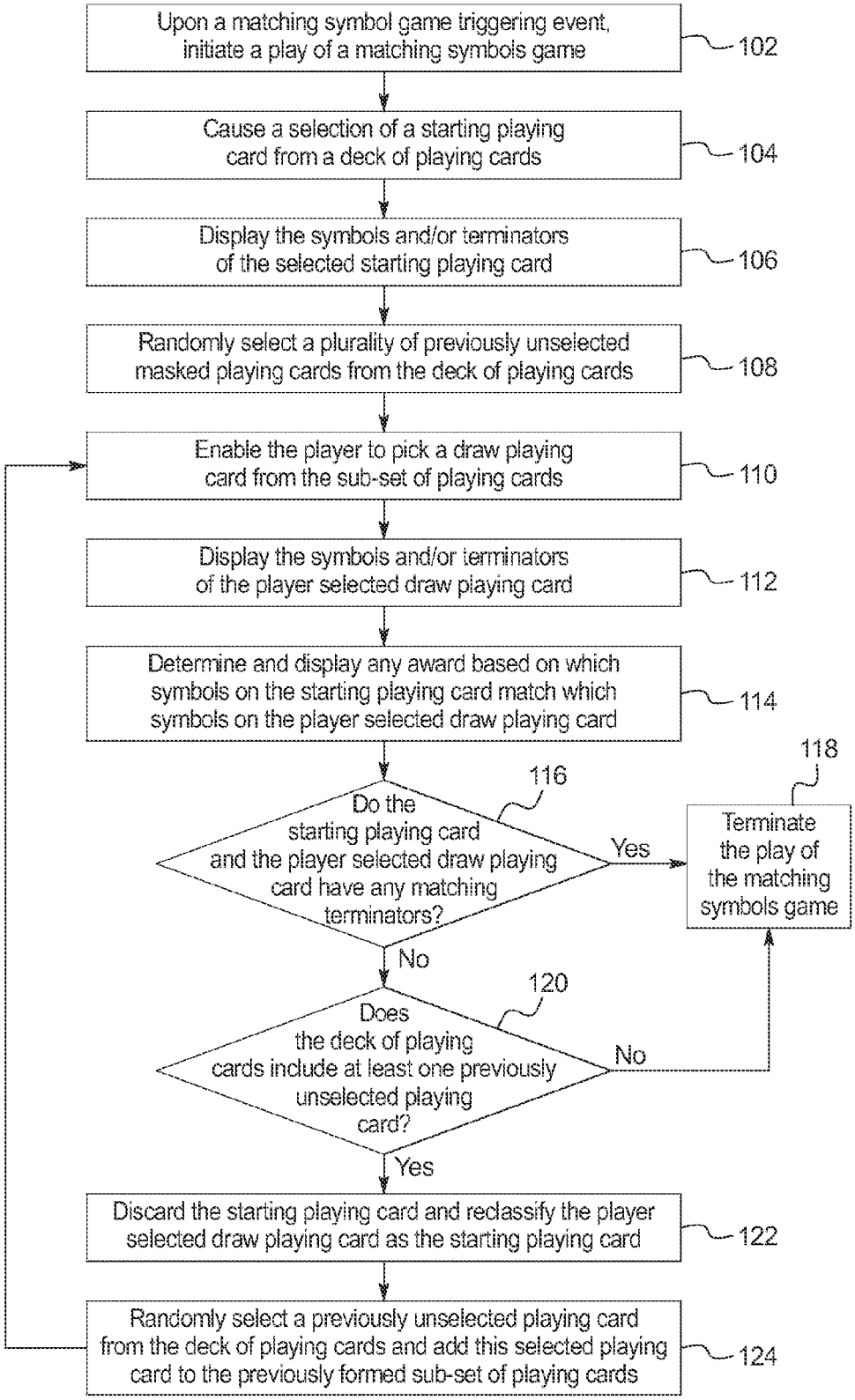
FIG. 1 is a flow chart an example process for operating a gaming system providing one embodiment of the matching symbols game disclosed herein.

Referring now to FIG. 1, a flowchart of an example embodiment of a process for operating a gaming system or a gaming device disclosed herein is illustrated. In one embodiment, this process is embodied in one or more software programs stored in one or more memories and executed by one or more processors or servers. Although this process is described with reference to the flowchart illustrated in FIG. 1, it should be appreciated that many other methods of performing the acts associated with this process may be used. For example, the order of certain steps described may be changed, or certain steps described may be optional.

In one embodiment, upon an occurrence of a matching symbols game triggering event, as indicated in block 102 of FIG. 1, the gaming system initiates or triggers a play of a matching symbols game. In one embodiment, the matching symbols game is a secondary or bonus game wherein a matching symbols game triggering event occurs based on a displayed event associated with a wagered on play of a primary game. In another embodiment wherein the matching symbols game is a secondary or bonus game, a matching symbols game triggering event occurs based on an event independent of any displayed event associated with a wagered on play of a primary game. In another embodiment, the matching symbols game is a primary game wherein a matching symbols game triggering event occurs upon a player placing a wager to play the matching symbols game.

In one embodiment, for the triggered matching symbols game, the gaming system causes a selection of a starting or comparison playing card from a deck or set of playing cards as indicated in block 104. In one such embodiment, the gaming system randomly selects the starting or comparison playing card from the deck or set of playing cards. In another such embodiment, the gaming system enables the player to select the starting or comparison playing card from the deck or set of playing cards.

In one embodiment, each of the playing cards of the deck or set of playing cards includes one or more of a plurality of symbols, wherein: (i) zero, one or more of the playing cards each include at least a plurality of the same symbol, and (ii) zero, one or more of the playing cards each include at least a plurality of different symbols. That is, each playing card includes a combination of one or more symbols wherein one or more symbols may each be included zero, one or more times on the same playing card (i.e., symbols may have multiple occurrences on a single playing card).

In addition to including one or more symbols, a plurality of the playing cards of the deck or set of playing cards each include one or more terminators. Such a configuration provides that: (i) zero, one or more of the playing cards each include a plurality of the same symbol and at least one terminator, (ii) zero, one or more of the playing cards each include a plurality of the same symbol and no terminators, (iii) zero, one or more of the playing cards each include a plurality of different symbols and at least one terminator, (iv) zero, one or more of the playing cards each include a plurality of different symbols and no terminators, (v) zero, one or more of the playing cards each include a plurality of the same symbol, at least one different symbol and at least one terminator, (vi) zero, one or more of the playing cards each include a plurality of the same symbol, at least one different symbol and no terminators, (vii) zero, one or more of the playing cards each include a plurality of the same symbol, a plurality of different symbols and at least one terminator, and (viii) zero, one or more of the playing cards each include a plurality of the same symbol, a plurality of different symbols and no terminators. It should thus be appreciated that such a configuration provides that the symbols of each of the playing cards form a distinct set of symbols. It should be further appreciated that the configuration of different symbols included or otherwise associated with different playing cards provides that in certain embodiments, any two playing cards include at least one pair of matching symbols between them.

Figure 2A:
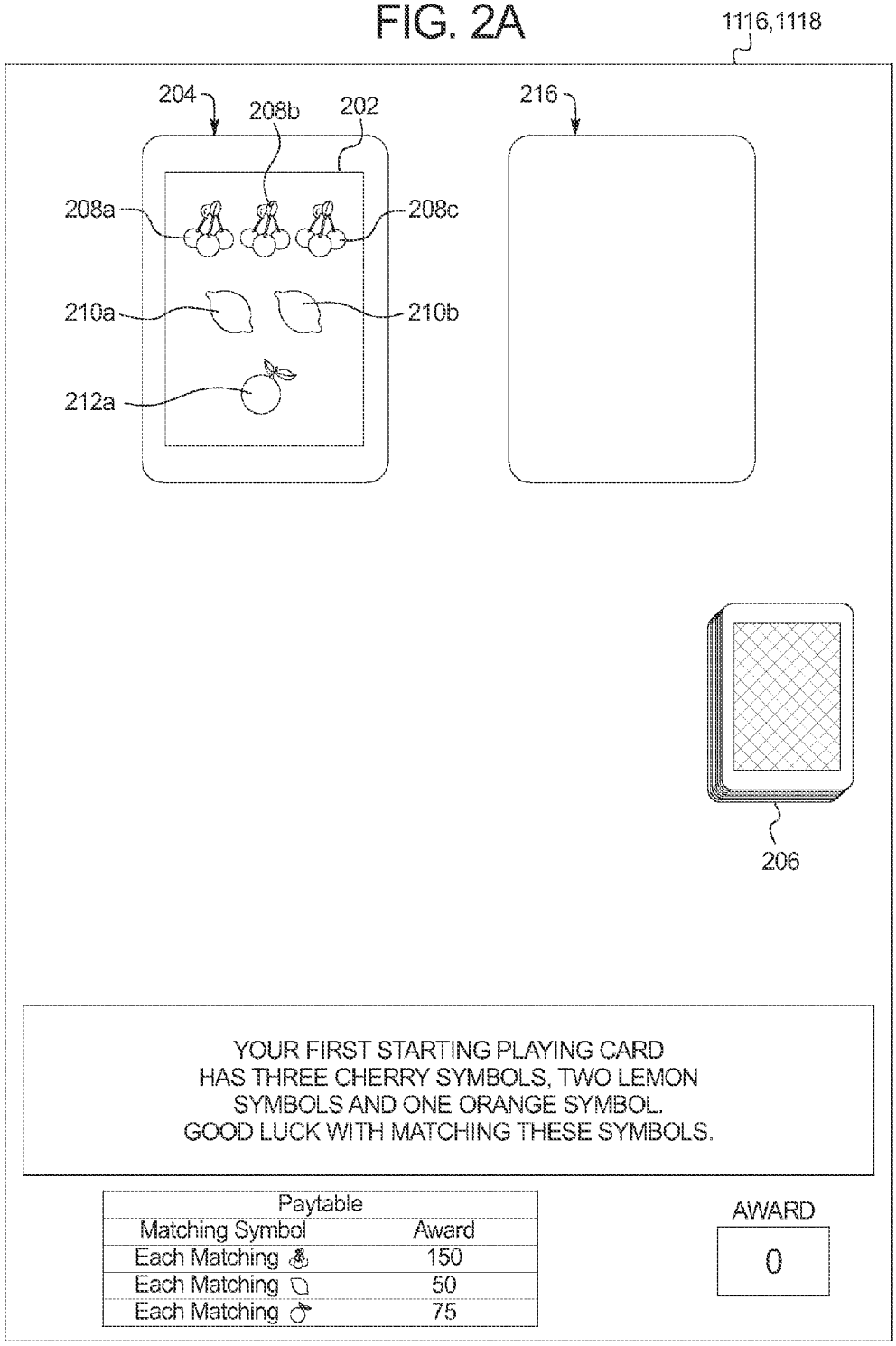

Following the selection of a starting or comparison playing card, the gaming system then displays the symbols and/or terminators of the selected starting or comparison playing card as indicated in block 106. For example, as seen in FIG. 2A, the starting playing card 202 (displayed in starting playing card position 204) initially selected from the deck of playing cards 206 includes three cherry symbols 208*a*, 208*b* and 208*c*, two lemon symbols 210*a* and 210*b* and one orange symbol 212*a*. In one embodiment, as seen in FIGS. 2A to 2E, to further increase the player's level of anticipation regarding which awards are available to win based on which potential matches are available, the gaming system displays a paytable to the player including the symbols on the player's starting playing card (and thus the gaming system displays to the player a paytable of the possible symbol matches associated with starting playing card 202). In this example, the gaming system provides appropriate messages such as "YOUR FIRST STARTING PLAYING CARD HAS THREE CHERRY SYMBOLS, TWO LEMON SYMBOLS AND ONE ORANGE SYMBOL" and "GOOD LUCK WITH MATCHING THESE SYMBOLS" to the player visually, or through suitable audio or audiovisual displays.

Following the selection of the starting playing card and the display of each of the symbols of the starting playing card, the gaming system randomly selects a plurality of previously unselected, masked playing cards from the deck or set of playing cards as indicated in block 108 of FIG. 1. This randomly selected plurality of playing cards forms a sub-set of playing cards.

While masking or otherwise not displaying the symbols of each of the playing cards in the formed sub-set of playing cards, the gaming system enables the player to pick a draw playing card from the sub-set of playing cards as indicated in block 110 of FIG. 1. That is, the gaming system enables the player to pick a face-down playing card from a randomly selected sub-set of the deck of playing cards. The gaming system then displays the symbols and/or terminators of the player selected draw playing card as indicated in block 112.

Figure 2B:
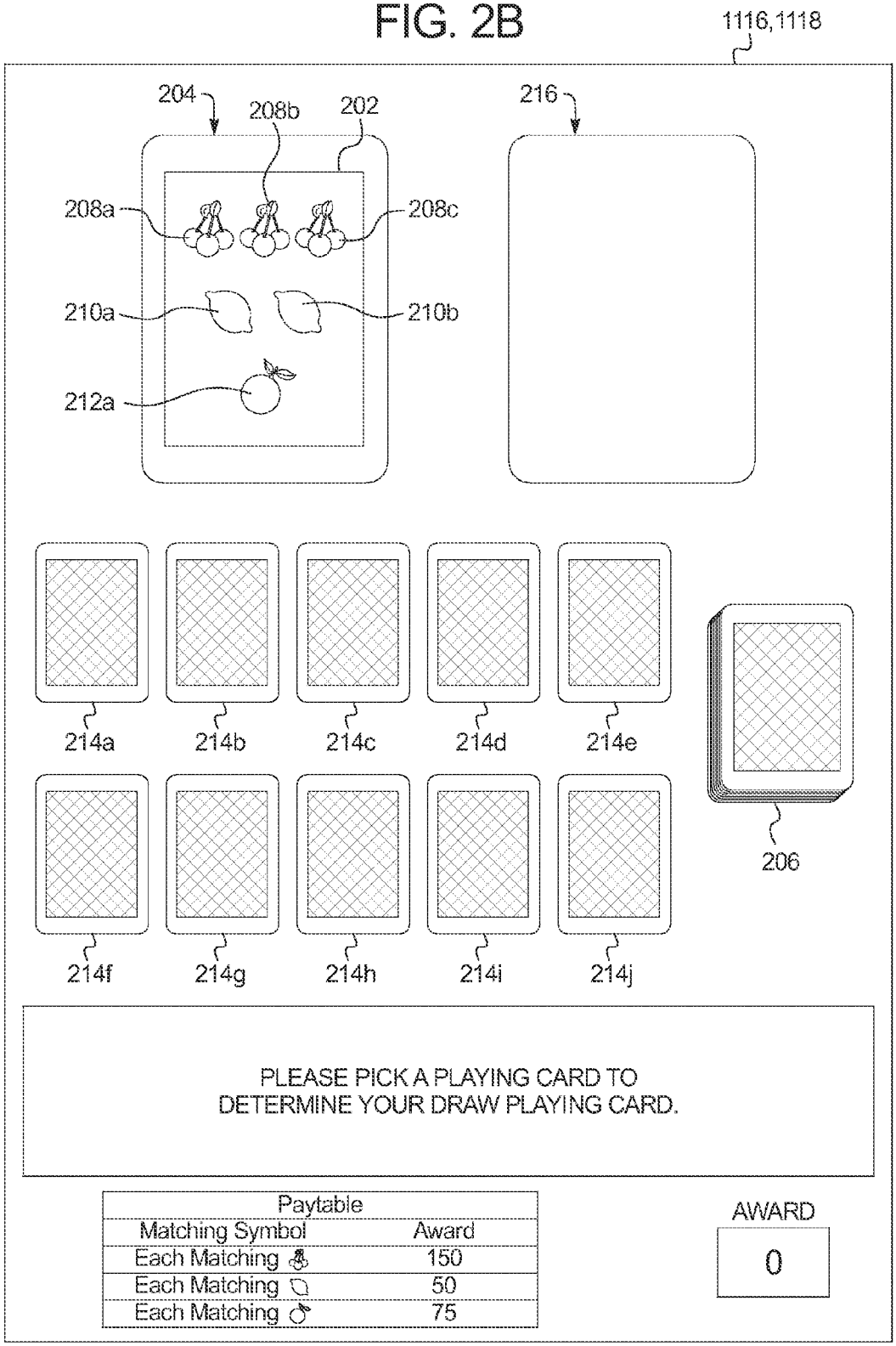

Continuing with the above example, as seen in FIG. 2B, the gaming system randomly selects ten, face down playing cards 214*a* to 214*j* from the deck of playing cards 206. In this example, the gaming system provides appropriate messages such as "PLEASE PICK A PLAYING CARD TO DETERMINE YOUR DRAW PLAYING CARD" to the player visually, or through suitable audio or audiovisual displays.

Figure 2C:
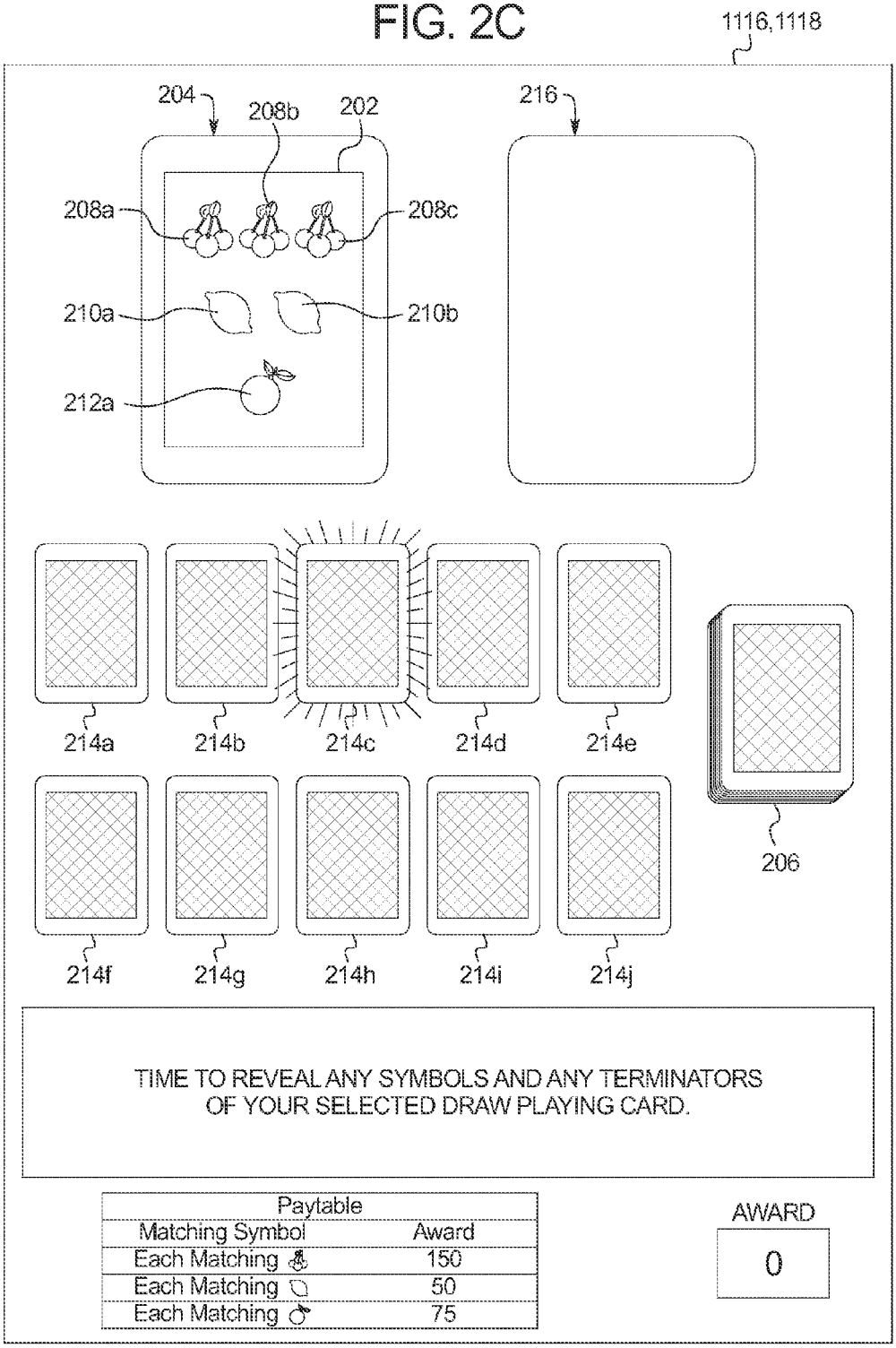

As seen in FIG. 2C, the player subsequently picked draw playing card 214*c* from the sub-set of playing cards. In this example, the gaming system provides appropriate messages such as "TIME TO REVEAL ANY SYMBOLS AND ANY TERMINATORS OF YOUR SELECTED DRAW PLAYING CARD" to the player visually, or through suitable audio or audiovisual displays.

Figure 2D:
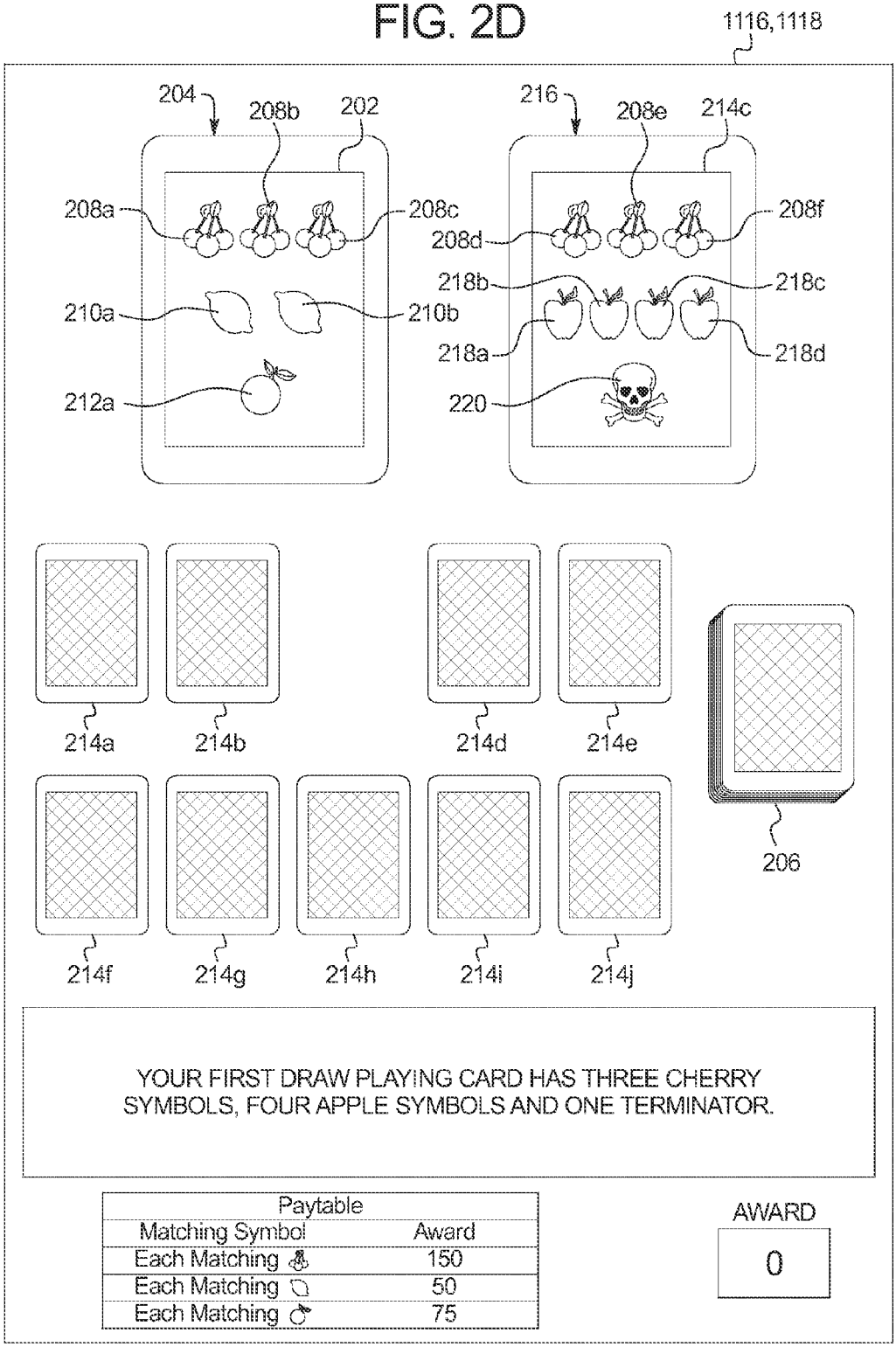

Following this selection, as seen in FIG. 2D, the gaming system revealed that the player picked draw playing card 214*c* (displayed in draw playing card position 216) includes three cherry symbols 208*d*, 208*e* and 208*f*, four apple symbols 218*a*, 218*b*, 218*c* and 218*d* and a terminator 220. In this example, the gaming system provides appropriate messages such as "YOUR FIRST DRAW PLAYING CARD HAS THREE CHERRY SYMBOLS, FOUR APPLE SYMBOLS AND ONE TERMINATOR" to the player visually, or through suitable audio or audiovisual displays.

Returning to FIG. 1, after the selection of the draw playing card and the display of the symbols and/or terminators of the draw playing card, the gaming system determines and displays any award based on which symbols on the starting playing card match which symbols on the player selected draw playing card as indicated in block 114. In one embodiment, the gaming system determines any awards based on: (i) which matching symbols occurred on both the starting playing card and the player selected draw playing card, and/or (ii) a quantity of matching symbols between the starting playing card and the player selected draw playing card. One such embodiment, different matching symbols are associated with different award amounts wherein the same quantity of matches between two different symbols are associated with different awards. In another such embodiment, different matching symbols are associated with the same award amount wherein the same quantity of matches between two different symbols are associated with the same award.

It should be appreciated that in one embodiment, the same symbol may be involved in a plurality of different matches between the starting playing card and the player selected draw playing card. That is, each match between a symbol of the starting playing card and a plurality of symbols of the player selected draw playing card is considered a separate match.

Figure 2E:
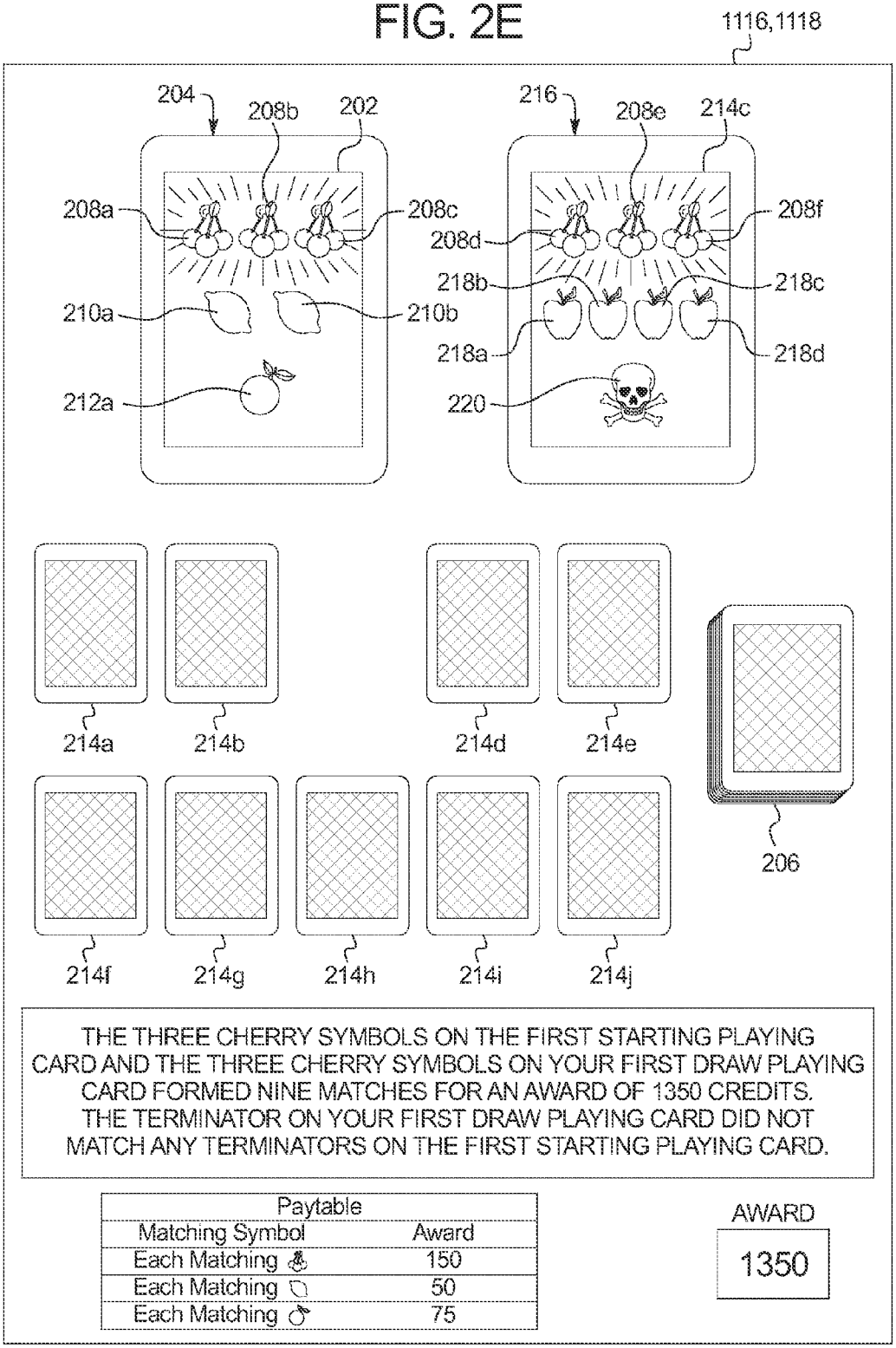

For example, as seen in FIG. 2E, based on the starting playing card 202 including three cherry symbols 208*a*, 208*b* and 208*c*, and the player picked draw playing card 214*c* also including three cherry symbols 208*d*, 208*e* and 208*f*, the gaming system determines that nine cherry symbol matches occur. Specifically, the gaming system determines: (i) a match between cherry symbol 208*a* on starting playing card 202 and cherry symbol 208*d* on player picked draw playing card 214*c*; (ii) a match between cherry symbol 208*a* on starting playing card 202 and cherry symbol 208*e* on player picked draw playing card 214*c*; (iii) a match between cherry symbol 208*a* on starting playing card 202 and cherry symbol 208*f* on player picked draw playing card 214*c*; (iv) a match between cherry symbol 208*b* on starting playing card 202 and cherry symbol 208*d* on player picked draw playing card 214*c*; (v) a match between cherry symbol 208*b* on starting playing card 202 and cherry symbol 208*e* on player picked draw playing card 214*c*; (vi) a match between cherry symbol 208*b* on starting playing card 202 and cherry symbol 208*f* on player picked draw playing card 214*c*; (vii) a match between cherry symbol 208*c* on starting playing card 202 and cherry symbol 208*d* on player picked draw playing card 214*c*; (viii) a match between cherry symbol 208*c* on starting playing card 202 and cherry symbol 208*e* on player picked draw playing card 214*c*; (ix) a match between cherry symbol 208*c* on starting playing card 202 and cherry symbol 2081 on player picked draw playing card 214*c*. In this example, after determining that an award of one-hundred-fifty credits is associated with a pair of matching cherry symbols, the gaming system displays an award of one-thousand-three-hundred-fifty credits (i.e., one-hundred-fifty credits per match x nine matches) for the symbol matches between the starting playing card and the player selected draw playing card. In this example, the gaming system provides appropriate messages such as "THE THREE CHERRY SYMBOLS ON THE FIRST STARTING PLAYING CARD AND THE THREE CHERRY SYMBOLS ON YOUR FIRST DRAW PLAYING CARD FORMED NINE MATCHES FOR AN AWARD OF 1350 CREDITS" to the player visually, or through suitable audio or audiovisual displays.

In addition to determining any awards based on any symbol matches, the gaming system determines if the starting playing card and the player selected draw playing card each have any matching or corresponding terminators as indicated in diamond 116 of FIG. 1. Put differently, after revealing the symbols and/or terminators of the starting player card and the player selected playing card, the gaming system determines: (i) any awards associated with any matching symbols and (ii) if any matching terminators affect any subsequent game play of the matching symbols game.

If the gaming system determines that the starting playing card and the player selected draw playing card have at least one set of matching or corresponding terminators, the gaming system terminates the play of the matching symbols game as indicated in block 118. In other words, the matching or association of two terminators between the starting playing card and the drawn playing card causes an end of the matching symbols game.

On the other hand, if the gaming system determines that the starting playing card and the player selected draw playing card do not have matching or corresponding terminators, the gaming system determines if the deck of playing cards includes at least one previously unselected playing card as indicated in diamond 120.

If the gaming system determines that the deck of playing cards does not include at least one previously unselected playing card, the gaming system terminates the play of the matching symbols game as indicated in block 118. That is, even if the gaming system determines that the starting playing card and the player selected draw playing card do not have matching or corresponding terminators, if the deck of playing cards is empty (i.e., the player has reached the final round of the matching symbols game), the gaming system causes an end of the matching symbols game.

On the other hand, if the deck of playing cards includes at least one previously unselected playing card (i.e., the player has not reached the final round of the matching symbols game), the gaming system discards the starting playing card and reclassifies the player selected draw playing card as the starting playing card as indicated in block 122. The gaming system then randomly selects a previously unselected playing card from the deck or set of playing cards and adds this selected playing card to the previously formed sub-set of playing cards as indicated in block 124. In other words, the gaming system replaces the previous player picked drawn playing card (now reclassified as the starting playing card) with another playing card randomly selected from the deck of playing cards to reform or recomplete the sub-set of playing cards.

Following the reformation of the sub-set of playing cards (i.e., the replacement of the previously selected draw playing card with a subsequently selected playing card), the gaming system returns to block 110 and while masking or otherwise not displaying the symbols of each of the playing cards in the formed sub-set of playing cards, proceeds as described above with enabling the player to pick a draw playing card from the reformed sub-set of playing cards. The gaming system thus continues for the next round of the matching symbols game by enabling the player to select another draw playing card and comparing the symbols of this draw playing card to the symbols of another starting playing card (i.e., the previously selected draw playing card).

For example, returning to FIG. 2E, the gaming system determines that although the player picked draw playing card 214*c* includes a terminator 220, since the starting playing card 202 does not include any terminators, no terminators match between the player picked draw playing card 214*c* and the starting playing card 202. In this example, the gaming system provides appropriate messages such as "THE TERMINATOR ON YOUR FIRST DRAW PLAYING CARD DID NOT MATCH ANY TERMINATORS ON THE FIRST STARTING PLAYING CARD" to the player visually, or through suitable audio or audiovisual displays.

Figure 2F:
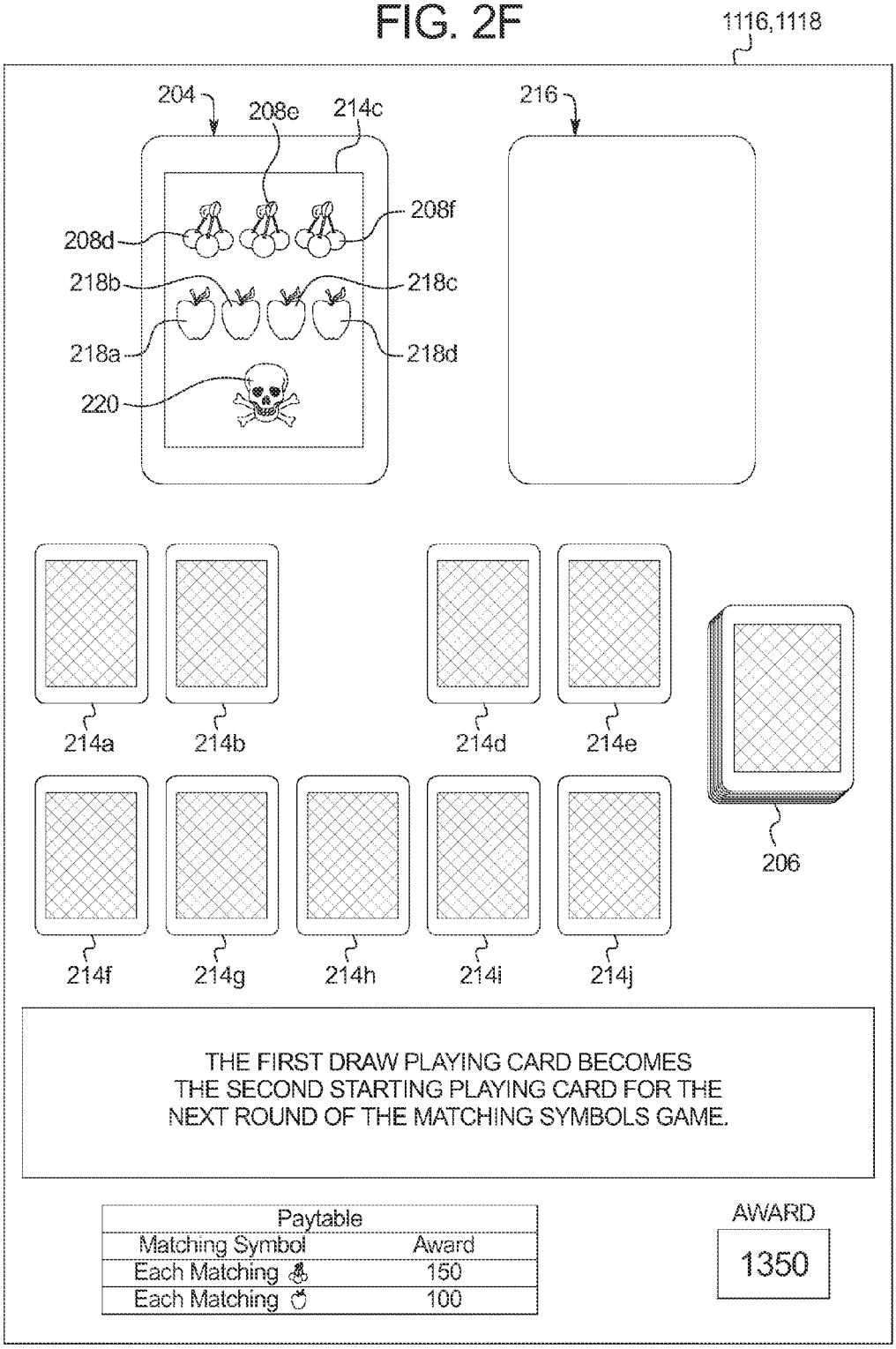

In this example, turning to FIG. 2F, since the deck of playing cards 206 includes at least one playing card, the gaming system discards the first starting playing card 202 and reclassifies the first player picked draw playing card 214*c* as the second starting playing card. The gaming system displays such a reclassification to the player by moving playing card 214*c* to starting playing card position 204.

In one embodiment, as seen in FIGS. 2F to 2J, to further increase the player's level of anticipation regarding which awards are available to win based on which potential matches are available, the gaming system displays a paytable to the player including the symbols on the player's current starting playing card (and thus the gaming system displays to the player a paytable of the possible symbol matches associated with reclassified starting playing card 214*c*). In this example, the gaming system provides appropriate messages such as "THE FIRST DRAW PLAYING CARD BECOMES THE SECOND STARTING PLAYING CARD FOR THE NEXT ROUND OF THE MATCHING SYMBOLS GAME" to the player visually, or through suitable audio or audiovisual displays.

Figure 2G:
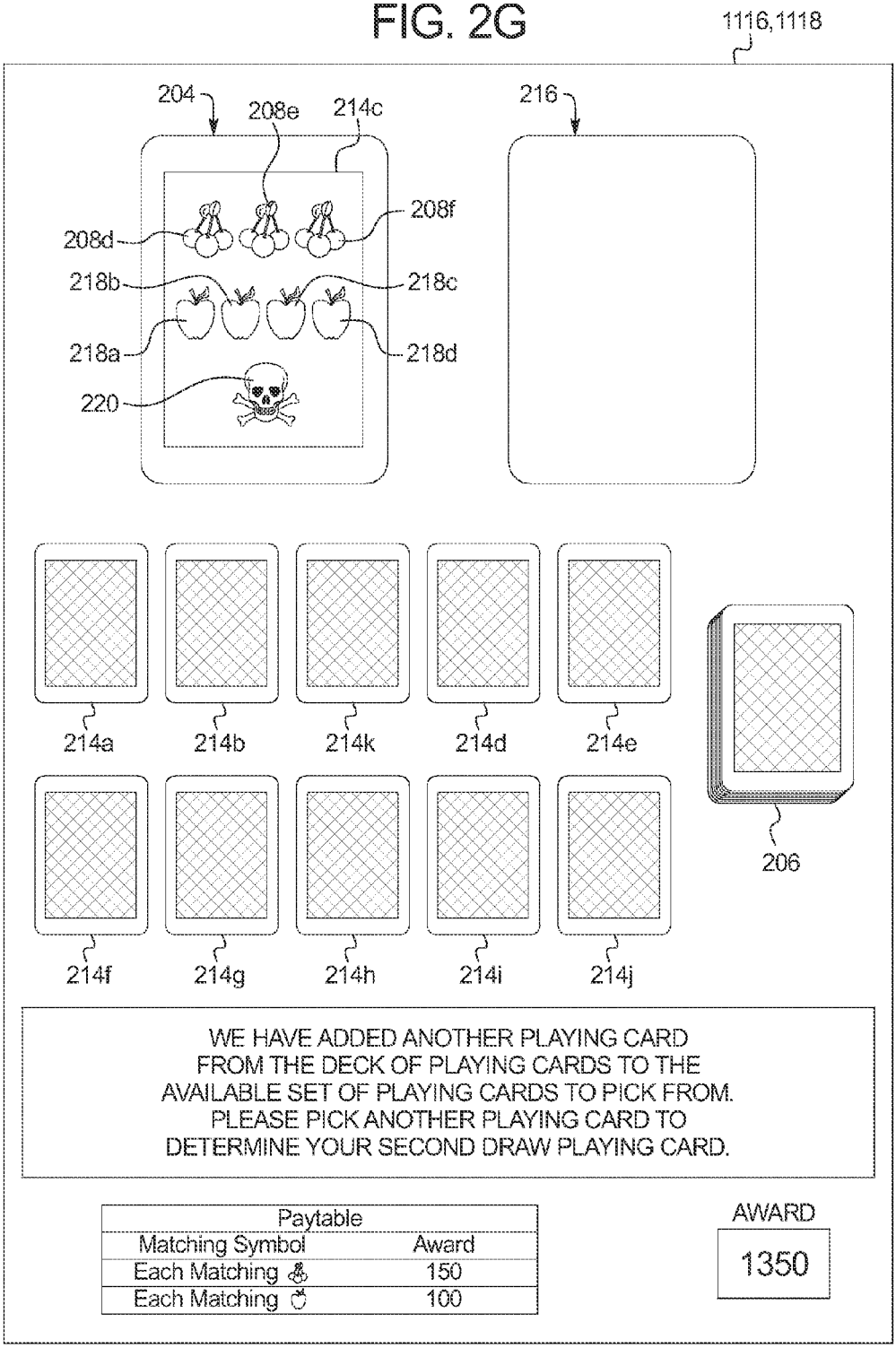

Following the reclassification of the first draw playing card as the second starting playing card, as seen in FIG. 2G, the gaming system adds a randomly selected playing card 214*k* from the deck of playing cards 206 to the formed sub-set of playing cards to form another complete sub-set of playing cards. The gaming system then enables the player to pick a second draw playing card from the sub-set of playing cards. In this example, the gaming system provides appropriate messages such as "WE HAVE ADDED ANOTHER PLAYING CARD FROM THE DECK OF PLAYING CARDS TO THE AVAILABLE SET OF PLAYING CARDS TO PICK FROM" and "PLEASE PICK ANOTHER PLAYING CARD TO DETERMINE YOUR SECOND DRAW PLAYING CARD" to the player visually, or through suitable audio or audiovisual displays.

Figure 2H:
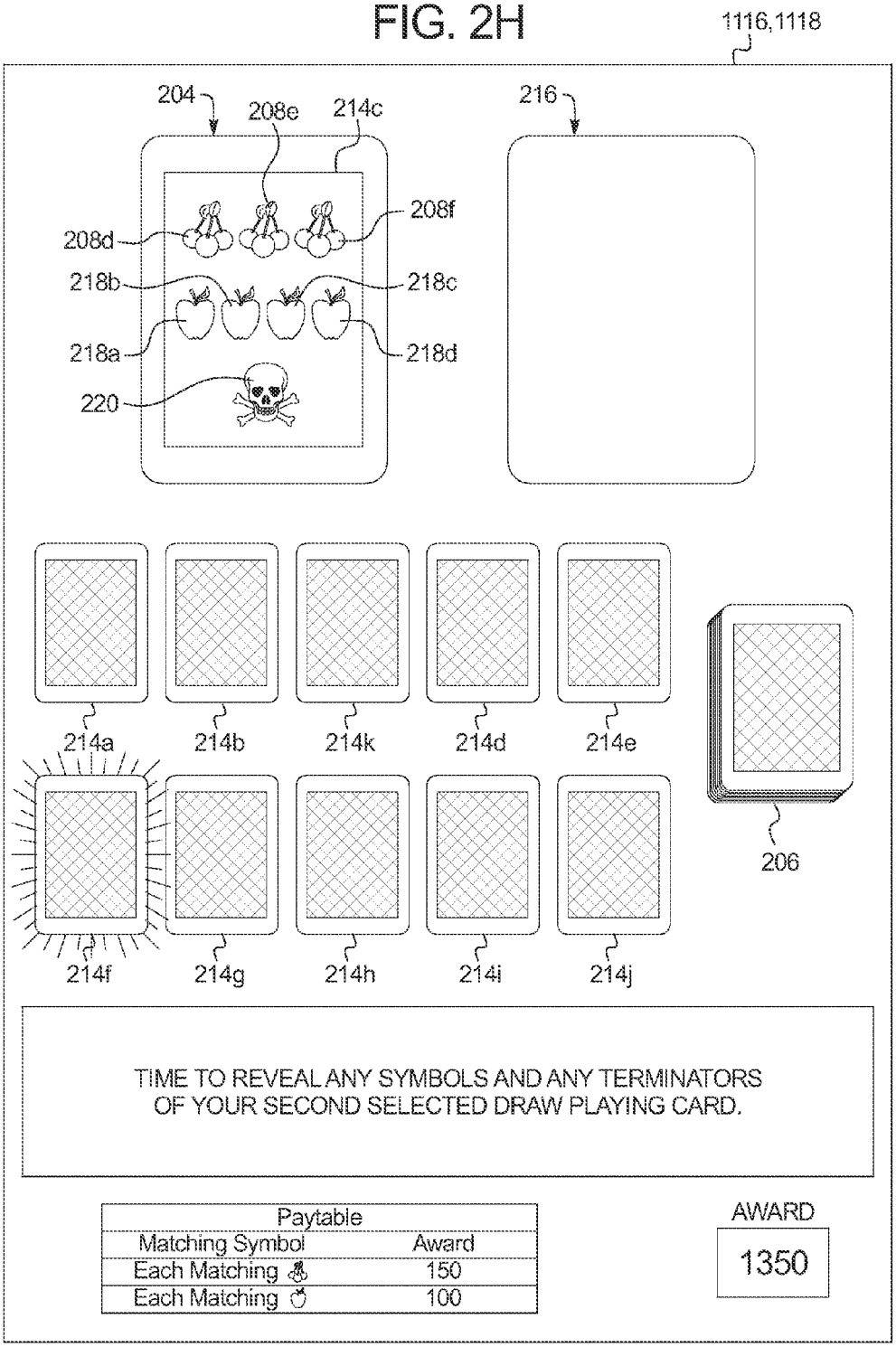
Figure 2I:
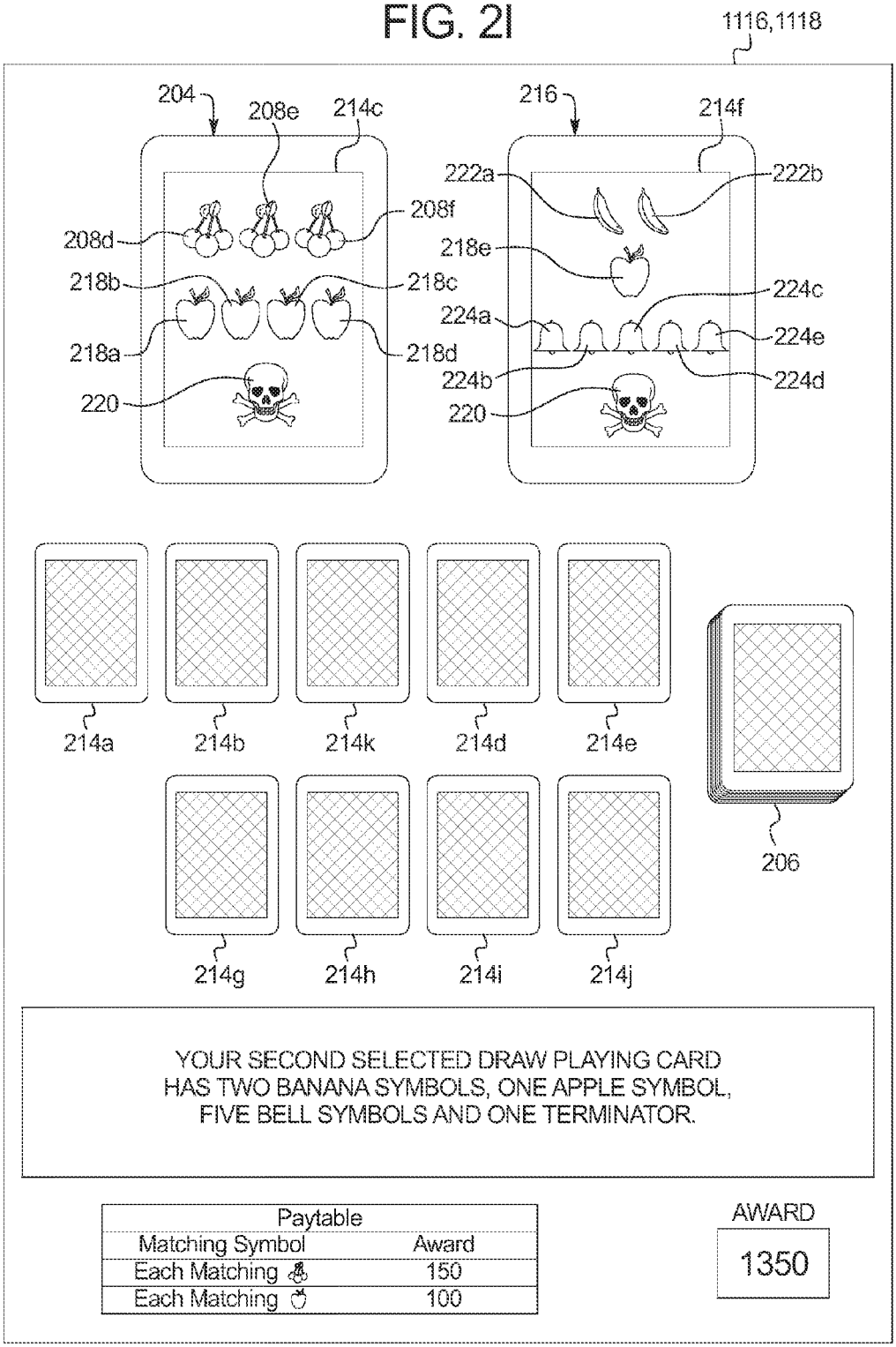

Continuing with the above example, as seen in FIGS. 2H and 2I, the player picked draw playing card 214*f* from the sub-set of playing cards and the gaming system revealed that the player picked draw playing card 214*f* (displayed in draw playing card position 216) includes two banana symbols 222*a* and 222*b*, one apple symbol 218*e*, five bell symbols 224*a*, 224*b*, 224*c*, 224*d* and 224*e* and a terminator 220. In this example, the gaming system provides appropriate messages such as "TIME TO REVEAL ANY SYMBOLS AND ANY TERMINATORS OF YOUR SECOND SELECTED DRAW PLAYING CARD" (as seen in FIG. 2H) and "YOUR SECOND SELECTED DRAW PLAYING CARD HAS TWO BANANA SYMBOLS, ONE APPLE SYMBOL, FIVE BELL SYMBOLS AND ONE TERMINATOR" (as seen in FIG. 2I) to the player visually, or through suitable audio or audiovisual displays.

As seen in FIG. 2J, after the selection of the second draw playing card and the display of the symbols and/or terminators of the second draw playing card, the gaming system determines that based on the second starting playing card 214*c* including four apple symbols 218*a*, 218*b*, 218*c* and 218*d* and the second player picked draw playing card 214*f* also including one apple symbols 218*e*, the gaming system determines that four apple symbol matches occur. Specifically, the gaming system determines: (i) a match between apple symbol 218*a* on the second starting playing card 214*c* and apple symbol 218*e* on the second player picked draw playing card 214*f*; (ii) a match between apple symbol 218*b* on the second starting playing card 214*c* and apple symbol 218*e* on the second player picked draw playing card 214*f*; (iii) a match between apple symbol 218*c* on the second starting playing card 214*c* and apple symbol 218*e* on the second player picked draw playing card 214*f*; and (iv) a match between apple symbol 218*d* on the second starting playing card 214*c* and apple symbol 218*e* on the second player picked draw playing card 214*f*. In this example, after determining that an award of one-hundred credits is associated with a pair of matching apple symbols, the gaming system displays an award of four-hundred credits (i.e., one-hundred credits per match x four matches) for the symbol matches between the second starting playing card and the second player selected draw playing card. In this example, the gaming system provides appropriate messages such as "THE FOUR APPLE SYMBOLS ON THE SECOND STARTING PLAYING CARD AND THE ONE APPLE SYMBOL ON YOUR SECOND SELECTED DRAW PLAYING CARD FORMED FOUR MATCHES FOR AN AWARD OF 400 CREDITS" to the player visually, or through suitable audio or audiovisual displays.

As further seen in FIG. 2J, in addition to providing the player the award associated with four matching apple symbols, the gaming system determines that the matching or corresponding terminators 220 between the second starting playing card 214*c* and the second player picked draw playing card 214*f* causes a termination event of the matching symbols game. Accordingly, the gaming system ends this play of the matching symbols game. In this example, the gaming system provides appropriate messages such as "THE TERMINATOR ON YOUR SECOND STARTING PLAYING CARD MATCHED THE TERMINATOR ON YOUR SECOND SELECTED DRAW PLAYING CARD" and "GAME OVER" to the player visually, or through suitable audio or audiovisual displays.

In another embodiment (not shown), rather than each playing card including a plurality of symbols (wherein the gaming system determines awards based on matching symbols between different playing cards), each playing card includes one symbol or symbol picture. The one symbol or symbol picture on each playing card includes a plurality of different attributes or characteristics, wherein the gaming system determines awards based on matching attributes or characteristics between different playing cards. For example, a starting playing card includes a symbol of a purple giraffe wearing tennis shoes in a desert setting and a player selected draw playing card includes a symbol of a purple elephant wearing snow boots shoes in a forest setting. In this example, the gaming system determines an award for the player based on the symbols of these two playing cards matching in the attributes or characteristics of color. It should be appreciated that in this embodiment, the greater the quantity of matching attributes or characteristics between playing cards (i.e., the more closely the two symbols of the two playing cards match), the greater the award provided to the player.

In one embodiment, as described above, for each round of the matching symbols game, the gaming system utilizes one starting playing card and one draw playing card. In another embodiment, for one or more rounds of the matching symbols game, the gaming system utilizes a plurality of starting playing cards and at least one draw playing card. In another embodiment, for one or more rounds of the matching symbols game, the gaming system utilizes at least one starting playing card and a plurality of draw playing cards. In another embodiment, for one or more rounds of the matching symbols game, the gaming system utilizes a plurality of starting playing cards and a plurality of draw playing cards. In these embodiments, the gaming system determines if any matching symbols occur and/or any terminators occur between the one or more starting playing cards and the one or more draw playing cards.

In one such embodiment employing at least one starting playing card and a plurality of draw playing cards, the gaming system does not discard any draw playing cards. In this embodiment, after determining any matches between the starting playing card and the first draw playing card, the gaming system provides an award for such matches and if no terminating event occurs, retains the first draw playing card and enables the player to select a second draw playing card. The gaming system then determines whether any matching symbols occur between the starting playing card, the first draw playing card and the second draw playing card. In such an embodiment, the gaming system provides any awards based on any matching symbols between the starting playing card, the first draw playing card and the second draw playing card.

In one such embodiment including retaining player selected draw playing cards, if no matching symbol occurs on each of the starting playing card, the first draw playing card and the second draw playing card, then regardless of if no matching or corresponding terminators occur, the gaming system terminates the play of the matching symbols game. On the other hand, in this embodiment, if at least one matching symbol occurs on each of the starting playing card the first draw playing card and the second draw playing card (and if no matching or corresponding terminators occur), the gaming system provides an award for such matches, retains the second draw playing card and proceeds with enabling the player to select a third draw playing card. Such a process continues with adding draw playing cards until no matching symbols occur between the starting playing card and each of the draw playing cards.

In another such embodiment including retaining player selected draw playing cards, regardless of if any matching symbol occurs on each of the starting playing card, the first draw playing card and the second draw playing card, if matching or corresponding terminators occur between a plurality of (or each of), the gaming system provides any award for any matching symbols and terminates the play of the matching symbols game. On the other hand, in this embodiment, regardless of if at least one matching symbol occurs on each of the starting playing card the first draw playing card and the second draw playing card (and if no matching or corresponding terminators occur between a plurality of (or each of)), the gaming system provides any award for any matching symbols, retains the second draw playing card and proceeds with enabling the player to select a third draw playing card. Such a process continues with adding draw playing cards until matching terminators occur between a plurality of (or each of) the starting playing card and the draw playing cards.

In another such embodiment including retaining player selected draw playing cards, if no matching symbol occurs on each of the starting playing card, the first draw playing card and the second draw playing card and/or matching or corresponding terminators occur, the gaming system terminates the play of the matching symbols game. On the other hand, in this embodiment, if at least one matching symbol occurs on each of the starting playing card the first draw playing card and the second draw playing card and no matching or corresponding terminators occur, the gaming system provides an award for such matches, retains the second draw playing card and proceeds with enabling the player to select a third draw playing card. Such a process continues with adding draw playing cards until no matching symbols occur between the starting playing card and each of the draw playing cards and/or matching or corresponding terminators occur.

In one embodiment, as described above, at least one pair of matching symbols will occur between any two playing cards from the deck of playing cards. In another embodiment, at least one pair of matching symbols will not necessarily occur between any two playing cards from the deck of playing cards. In one such embodiment wherein the playing cards do not include any terminators, if no matching symbols occur between a starting playing card and a draw playing card, the gaming system terminates the play of the matching symbols game. In another such embodiment wherein the playing cards include terminators, the gaming system terminates the play of the matching symbols game when either no matching symbols occur between a starting playing card and a draw playing card or matching or corresponding terminators occur between the starting playing card and the draw playing card.

In one embodiment, as illustrated in the example of FIG. 2A to 2J above, the same symbol may be involved in a plurality of different matches between the starting playing card and the player selected draw playing card. In another embodiment, the same symbol may be involved in a finite quantity of symbol matches, such as one symbol match, between the starting playing card and the player selected draw playing card. In one such embodiment, if a plurality of matches exist between a symbol on both the starting playing card and the player selected draw playing card, the gaming system determines which of the plurality of matches to provide an award based on.

In one embodiment, as illustrated in the example of FIG. 2A to 2J above, the gaming system determines that a match occurs between the same symbol appearing or being included on a starting playing card and a player selected draw playing card. In another embodiment, the gaming system determines that a match occurs between different symbols appearing or being included on a starting playing card and a player selected draw playing card. In one such embodiment, a match occurs between different symbols appearing or being included on a starting playing card and a player selected draw playing card when such different symbols belong in the same category of symbols. For example, the gaming system determines that a king symbol on one of a starting playing card and a draw playing cards matches a queen symbol on one of the starting playing card and the draw playing card because both symbols are in the category of face card symbols. In another embodiments, the gaming system determines that certain matches occur between the same symbol appearing or being included on a starting playing card and a player selected draw playing card and that certain matches occur between different symbols appearing or being included on a starting playing card and a player selected draw playing card.

In one embodiment, as described above, the gaming system determines, round by round of the matching symbols game, if any matches occur and provides any awards associated with any matched symbols. In another embodiment, the gaming system additionally or alternatively determines, cumulatively for each of the played rounds of the matching symbols game, if any matches occur and provides any awards associated with any matched symbols. That is, the gaming system tracks and accumulates matching symbols over one or more rounds of the matching symbols game wherein upon the completion of the matching symbols game, the gaming system provides the player an award based on the accumulated matching symbols. For example, if a player matches five knight symbols during over one or more rounds of the matching symbols game, the gaming system provides the player an award associated with competing a knight symbol set.

In one embodiment, as described above, for each round of the matching symbols game, the gaming system utilizes the same deck of playing cards wherein if each of the playing cards of the deck of playing cards are utilized as a draw playing card, the gaming system terminates the play of the matching symbols game. In one such embodiment, after providing one or more awards for any matching symbols and determining that no terminators are matched, if the gaming system determines that the deck of playing cards does not include at least one previously unselected playing card but the sub-set of playing cards includes at least one previously unselected playing card, the gaming system skips the reformation of the sub-set of playing cards and proceeds to enabling the player to select another draw playing card as described above. In another embodiment, for one or more rounds of the matching symbols game, the gaming system utilizes a different deck of playing cards. It should be appreciated that the matching symbols game of such an embodiment terminates when matching or corresponding terminators occur between the starting playing card and the draw playing card.

In one embodiment, as described above, following the selection of the starting playing card and the display of each of the symbols of the starting playing card, the gaming system randomly selects a plurality of previously unselected, masked playing cards from the deck or set of playing cards and enables the player to pick a draw playing card from the sub-set of playing cards. In another embodiment, following the selection of the starting playing card and the display of each of the symbols of the starting playing card, the gaming system selects a draw playing card. In one such embodiment, the gaming system randomly select a draw playing card from the deck of playing cards.

In one embodiment, as described above, the matching symbols game continues until either matching or corresponding terminators occur or the deck of playing cards is empty. In another embodiment, the gaming system provides the player a static quantity of comparisons between starting playing cards and draw playing cards. For example, the gaming system provides the player five draw playing card selections wherein each draw playing card is compared against a starting playing card (such as a previously selected draw playing card) to determine any symbol matches which determines any awards. In one such embodiment wherein the playing cards do not include any terminators, the gaming system terminates the play of the matching symbols game after the static quantity of comparisons. In another such embodiment wherein the playing cards include terminators, the gaming system terminates the play of the matching symbols game either after the static quantity of comparisons or when matching or corresponding terminators occur between the starting playing card and the draw playing card. In certain such embodiment, a plurality of the playing cards include retrigger symbols wherein matching retrigger symbols cause a modification of the static quantity of comparisons, such as a resetting of the quantity of comparisons or adding one or more comparisons to the static quantity.

In one embodiment, as described above, any matching of terminators across a starting playing card and a draw playing card terminates the play of the matching symbols game. In another embodiment, the gaming system employs different terminators which affect the play of the matching symbols game differently. For example, one set of matching or corresponding terminators terminate the play of the matching symbols game while another set of matching or corresponding terminators reduces the player's current award. In another example, the gaming system reduces the player's current award when non-matching or non-corresponding terminators occur between a starting playing card and a draw playing card and the gaming system terminates the play of the matching symbols game when matching or corresponding terminators occur between a starting playing card and a draw playing card. In another embodiment, the player's starting card is guaranteed not to have any terminator symbols on it such that the play of the matching symbols game will not end prematurely.

In one embodiment, the gaming system provides a group gaming aspect to the matching symbols game disclosed herein. In one such embodiment, the matching symbols game is a cooperative community game wherein a plurality of players cooperate or play together to win one or more awards. In another such embodiment, the matching symbols game is a competition community game wherein a plurality of players compete or player against each other to win one or more awards.

In one embodiment wherein the matching symbols game is a cooperative community game, the gaming system provides, to each of the players (or to a plurality of the players) of the community game, the award associated with one or more symbol matches between the starting playing card and the draw playing cards. In one such embodiment, the gaming system assigns the starting playing card to a specific player and/or assigns the draw playing card to a specific player. In this embodiment, in addition to providing these players the awards associated with one or more symbol matches between the starting playing card and the draw playing cards, the gaming system provides these specific players additional awards based on the assignments of such playing cards.

In one embodiment wherein the matching symbols game is a competitive community game, the gaming system provides an award to one or more (but not each of) a plurality of players, wherein the award is based on one or more symbol matches between the starting playing card and the draw playing cards. In one embodiment, the gaming system assigns one or more starting playing cards and/or one or more draw playing cards to each of one or more players. In one such embodiment, the gaming system determines whether to provide a player one or more awards based on one or more symbol matches between the player's assigned starting playing card and one or more draw playing cards. In another such embodiment, the gaming system determines whether to provide a player one or more awards based on one or more symbol matches between one or more starting playing cards and the player's assigned draw playing cards. In another such embodiment, the gaming system determines whether to provide a player one or more awards based on one or more symbol matches between the player's assigned starting playing card and the player's assigned draw playing cards.

In another embodiment of a community game, the gaming system provides each player a different starting playing card. The gaming system displays, on a community display device, a quantity of face-up draw playing cards equal to the quantity of players. In this embodiment, the gaming system randomly assigns each draw playing card to one of the plurality of players of the community game. Such an embodiment increases the level of excitement for certain players because such player anticipate which draw playing cards they hope to be assigned (i.e., draw playing cards that match symbols on the player's starting playing card(s) without any terminator symbols). In these embodiments, as a result of the drawing card a player is assigned, that individual player may match terminator symbols and/or fail to obtain any more matches (and thus that player would not participate in future rounds of the community game). In each future round of such a community game, the gaming system; (i) displays, on the community display device, a quantity of face-up draw playing cards equal to the quantity of players still participating in the community game, and (ii) randomly assigns each displayed draw playing card to each player still participating in the community game. The gaming system of this embodiment terminates or ends the community game when each the players have satisfied the ending condition (i.e., each of the player have matched terminator symbols, and/or not obtained any more matches).

In one embodiment, the gaming system causes at least one display device of the player's gaming device to display the matching symbols game. In another embodiment, in addition or in alternative to each gaming device displaying the matching symbols game, the gaming system causes one or more community or overhead display devices to display part or all of the matching symbols game to one or more other players or bystanders either at a gaming establishment or viewing over a network, such as the internet. In another embodiment, in addition or in alternative to each gaming device displaying the matching symbols game, the gaming system causes one or more internet sites to each display the matching symbols game such that a player is enabled to log on from a personal web browser. In another such embodiment, the gaming system enables the player to play one or more primary games on one device while viewing the matching symbols game from another device. For example, the gaming system enables the player to play one or more primary games on a mobile phone while viewing the status of the matching symbols game on a desktop or laptop computer.

In another embodiment, as mentioned above, a matching symbols game triggering event occurs, based on an outcome associated with one or more plays of any primary game and/or an outcome associated with one or more plays of any secondary game of the gaming devices in the gaming system. In one embodiment, such determinations are symbol driven based on the generation of one or more designated symbols or symbol combinations. In various embodiments, a generation of a designated symbol (or sub-symbol) or a designated set of symbols (or sub-symbols) over one or more plays of a primary game causes a matching symbols game triggering event to occur.

In another embodiment, as also mentioned above, the gaming system does not provide any apparent reasons to the players for a matching symbols game triggering event to occur. In these embodiments, such determinations are not triggered by an event in a primary game or based specifically on any of the plays of any primary game or on any of the plays of any secondary game of the gaming devices in the system. That is, these events occur without any explanation or alternatively with simple explanations.

In one embodiment, a matching symbols game triggering event occurs, based on an amount coin-in. In this embodiment, the gaming system determines if an amount of coin-in wagered at one or more gaming devices in the gaming system reaches or exceeds a designated amount of coin-in (i.e., a threshold coin-in amount). Upon the amount of coin-in wagered at one or more gaming devices in the gaming system reaching or exceeding the bonus threshold coin-in amount, the gaming system causes one or more of such events or conditions to occur. In different embodiments, the threshold coin-in amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In another alternative embodiment, a matching symbols game triggering event occurs, based on an amount coin-out. In this embodiment, the gaming system determines if an amount of coin-out provided by one or more gaming devices in the gaming system reaches or exceeds a designated amount of coin-out (i.e., a threshold coin-out amount). Upon the amount of coin-out provided at one or more gaming devices in the gaming system reaching or exceeding the threshold coin-out amount, the gaming system causes one or more of such events or conditions to occur. In different embodiments, the threshold coin-out amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In another alternative embodiment, a matching symbols game triggering event occurs, based on a predefined variable reaching a defined parameter threshold. For example, when the 500,000$^{th}$ player has played a gaming device of the gaming system (ascertained from a player tracking system), one or more of such events or conditions occur. In different embodiments, the predefined parameter thresholds include a length of time, a length of time after a certain dollar amount is hit, a wager level threshold for a specific device (which gaming device is the first to contribute $250,000), a number of gaming devices active, or any other parameter that defines a suitable threshold.

In another alternative embodiment, a matching symbols game triggering event occurs, based on a quantity of games played. In this embodiment, a quantity of games played is set for when one or more of such events or conditions will occur. In one embodiment, such a set quantity of games played is based on historic data.

In another alternative embodiment, a matching symbols game triggering event occurs, based on time. In this embodiment, a time is set for when one or more of such events or conditions will occur. In one embodiment, such a set time is based on historic data.

In another alternative embodiment, a matching symbols game triggering event occurs, based upon gaming system operator defined player eligibility parameters stored on a player tracking system (such as via a player tracking card or other suitable manner). In this embodiment, the parameters for eligibility are defined by the gaming system operator based on any suitable criterion. In one embodiment, the gaming system recognizes the players identification (via the player tracking system) when the player inserts or otherwise associates their player tracking card in the gaming device. The gaming system determines the player tracking level of the player and if the current player tracking level defined by the gaming system operator is eligible for one or more of such events or conditions. In one embodiment, the gaming system operator defines minimum bet levels required for such events or conditions to occur based on the player's card level.

In another alternative embodiment, a matching symbols game triggering event occurs, based on a system determination, including one or more random selections by the central controller. In one embodiment, as described above, the central controller tracks all active gaming devices and the wagers they placed. In one such embodiment, based on the gaming device's state as well as one or more wager pools associated with the gaming device, the central controller determines whether to one or more of such events or conditions will occur. In one such embodiment, the player who consistently places a higher wager is more likely to be associated with an occurrence of one or more of such events or conditions than a player who consistently places a minimum wager. It should be appreciated that the criteria for determining whether a player is in active status or inactive status for determining if one or more of such events occur may the same as, substantially the same as, or different than the criteria for determining whether a player is in active status or inactive status for another one of such events to occur.

In another alternative embodiment, a matching symbols game triggering event occurs, based on a determination of if any numbers allotted to a gaming device match a randomly selected number. In this embodiment, upon or prior to each play of each gaming device, a gaming device selects a random number from a range of numbers and during each primary game, the gaming device allocates the first N numbers in the range, where N is the number of credits bet by the player in that primary game. At the end of the primary game, the randomly selected number is compared with the numbers allocated to the player and if a match occurs, one or more of such events or conditions occur. It should be appreciated that any suitable manner of causing a matching symbols game triggering event to occur may be implemented in accordance with the gaming system and method disclosed herein.

It should be appreciated that any of the above-described matching symbols game triggering events may be combined in one or more different embodiments.

Alternative Embodiments

It should be appreciated that in different embodiments, one or more of:

i. a quantity of cards in a deck or set of playing cards;
ii. a quantity of decks or sets of playing cards employed;
iii. a quantity of symbols on one or more playing cards;
iv. which symbols to include on which playing cards;
v. a quantity of the same symbol included on one or more playing cards;
vi. a quantity of different symbols included on one or more playing cards;
vii. a quantity of starting playing cards employed per game or per round;
viii. which starting playing cards are selected;
ix. a quantity of playing cards in the sub-set of playing cards which the player selects one or more draw playing cards from;
x. a quantity of draw playing cards selected from the sub-set of playing cards;
xi. a quantity of replacement cards selected from the deck of playing cards to replace any playing cards selected from the sub-set of playing cards;
xii. which symbols match which other symbols;
xiii. which matched symbols are associated with which awards;
xiv. a quantity of matches associated with one or more awards;
xv. which quantities of matches are associated with which awards;
xvi. a static quantity of playing cards selected by the player in the play of the matching symbols game;
xvii. whether one or more playing cards include one or more retrigger symbols;
xviii. a quantity of playing cards which include retrigger symbols;
xix. which playing cards include retrigger symbols;
xx. whether one or more playing cards include one or more terminators;
xxi. a quantity of playing cards which include terminators;
xxii. which playing cards include terminators;
xxiii. a quantity of attributes or characteristics of one or more symbol pictures;
xxiv. which playing cards include which symbol pictures;
xxv. a quantity of playing cards which include symbol pictures; and
xxvi. any determination disclosed herein;

is/are predetermined, randomly determined, randomly determined based on one or more weighted percentages, determined based on a generated symbol or symbol combination, determined independent of a generated symbol or symbol combination, determined based on a random determination by the central controller, determined independent of a random determination by the central controller, determined based on a random determination at the gaming system, determined independent of a random determination at the gaming system, determined based on at least one play of at least one game, determined independent of at least one play of at least one game, determined based on a player's selection, determined independent of a player's selection, determined based on one or more side wagers placed, determined independent of one or more side wagers placed, determined based on the player's primary game wager, determined independent of the player's primary game wager, determined based on time (such as the time of day), determined independent of time (such as the time of day), determined based on an amount of coin-in accumulated in one or more pools, determined independent of an amount of coin-in accumulated in one or more pools, determined based on a status of the player (i.e., a player tracking status), determined independent of a status of the player (i.e., a player tracking status), determined based on one or more other determinations disclosed herein, determined independent of any other determination disclosed herein or determined based on any other suitable method or criteria.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines ("EGMs"); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 3A:
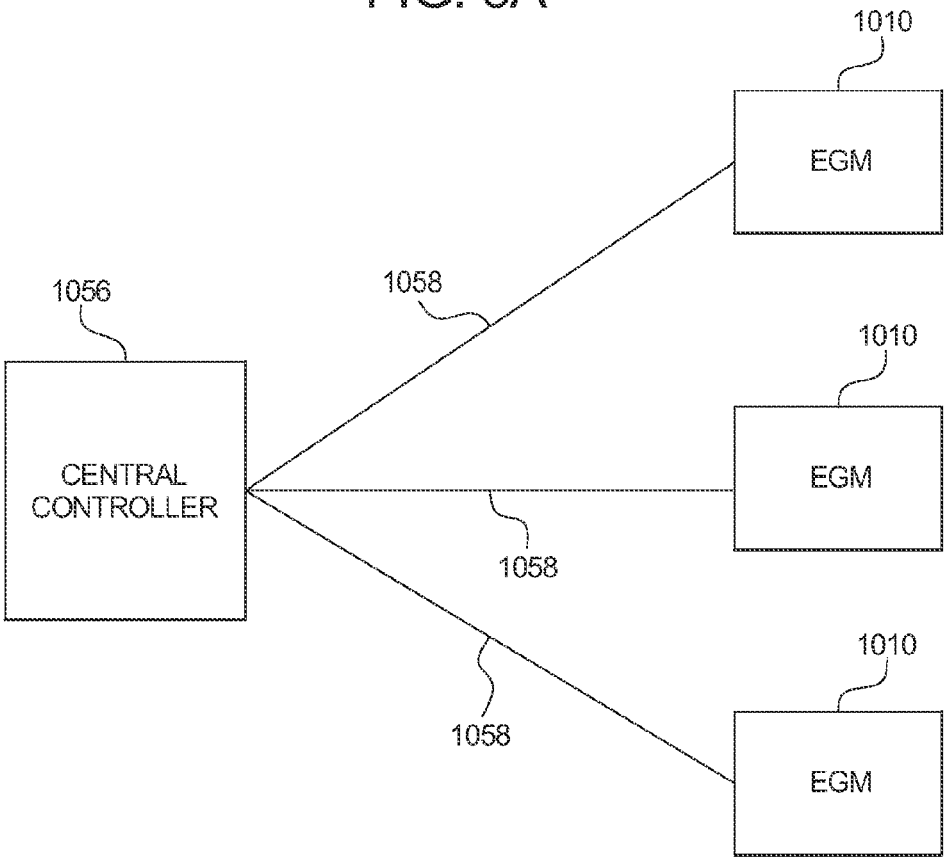
FIG. 3A is a schematic block diagram of one embodiment of a network configuration of the gaming system disclosed herein.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 3A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described herein, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network: and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 3B:
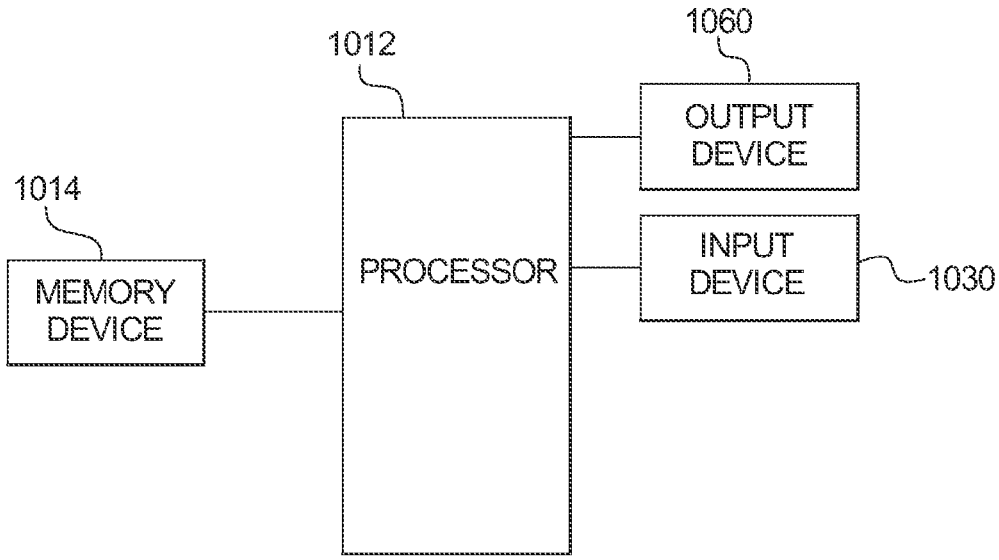
FIG. 3B is a schematic block diagram of one embodiment of an electronic configuration of the gaming system disclosed herein.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 3B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 3B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 4A:
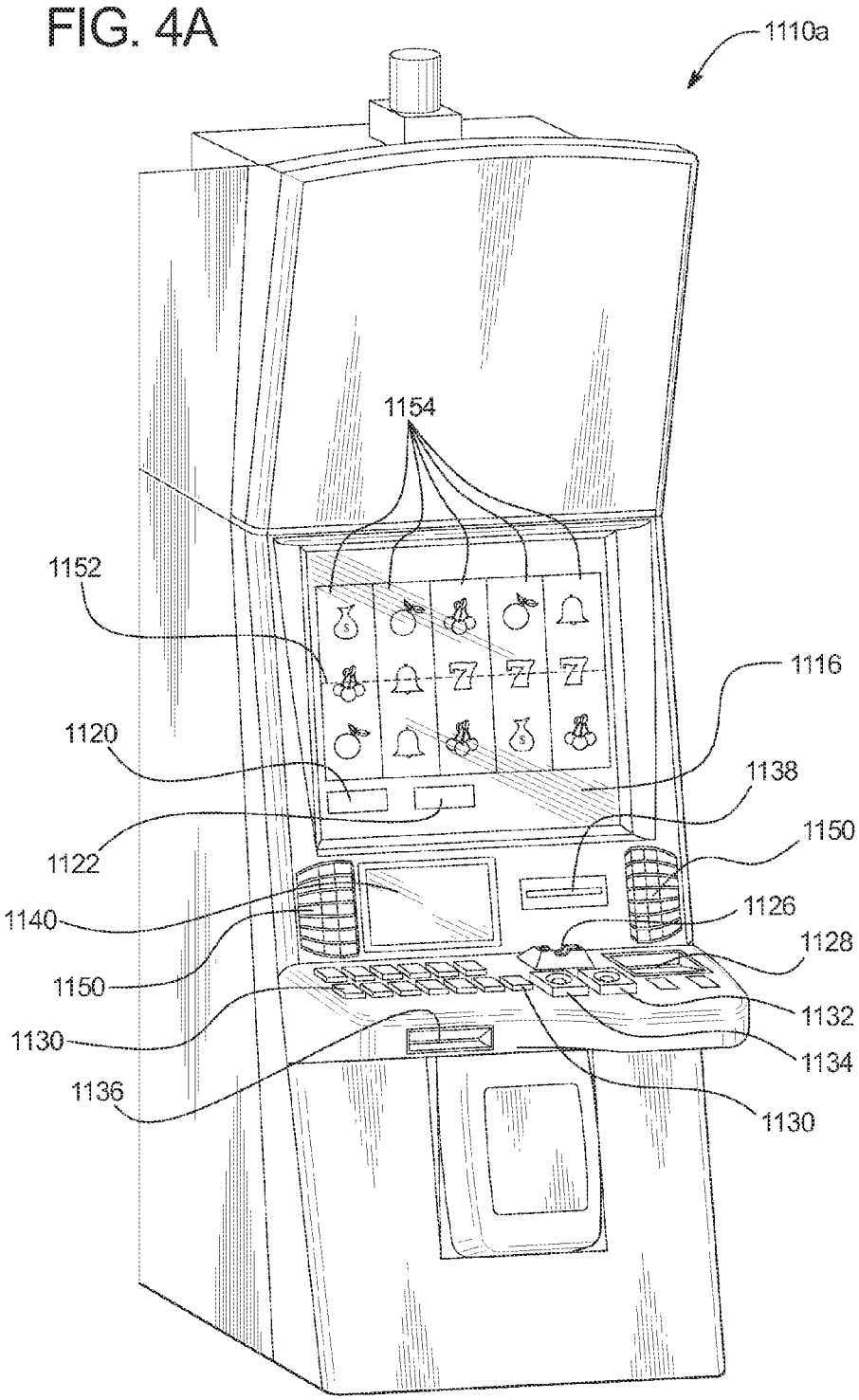
FIGS. 4A and 4B are perspective views of example alternative embodiments of the gaming system disclosed herein.
Figure 4B:
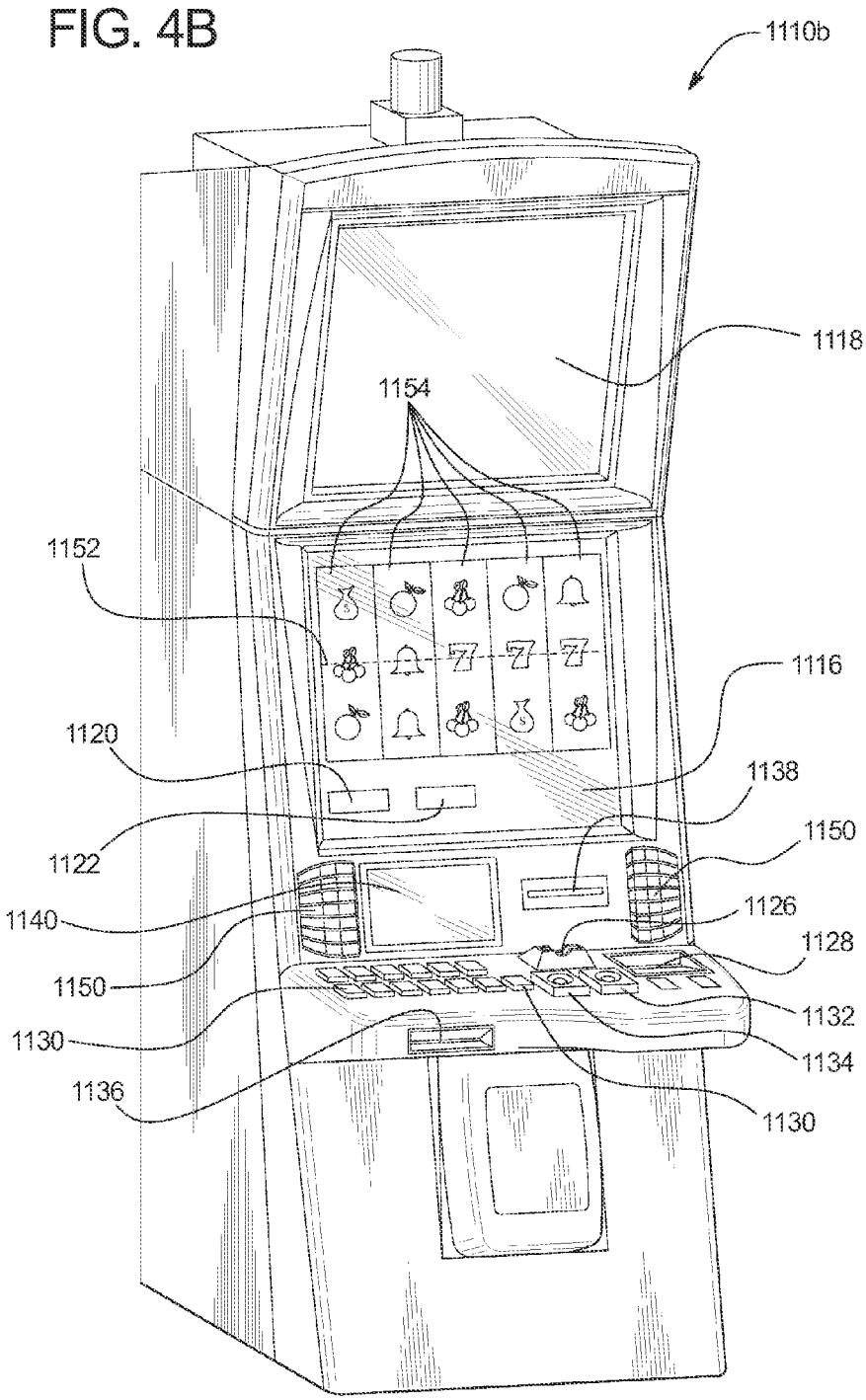

In various embodiments, the EGM includes one or more input devices. The input devices may include any suitable device that enables an input signal to be produced and received by the at least one processor of the EGM. The example EGM illustrated in FIG. 3B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 4A and 4B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 4A and 4B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one. It should be appreciated that while the player's credit balance, the player's wager, and any awards are displayed as an amount of monetary credits or currency in the embodiments described herein, one or more of such player's credit balance, such player's wager, and any awards provided to such player may be for non-monetary credits, promotional credits, and/or player tracking points or credits.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 4A and 4B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 4A and 4B each include a card reader 1138. The card reader is configured to read a player identification card inserted into the card reader.

In various embodiments, the EGM includes one or more output devices. The example EGM illustrated in FIG. 3B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 4A includes a central display device 1116, a player tracking display 1140, a credit display 1120, and a bet display 1122. The example EGM illustrated in FIG. 4B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 4A and 4B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 4A and 4B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 4A and 4B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 4A and 4B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 4A and 4B each include a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display positions on a requisite number of adjacent reels. In one such embodiment, one or more paylines are formed between at least two symbol display positions that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display positions, the gaming system enables a wager to be placed on a plurality of symbol display positions, which activates those symbol display positions.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display positions on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 200910123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased: rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one display device;

at least one input device;

at least one processor; and at least one memory device which stores a plurality of instructions, which when executed by the at least one processor, cause the at least one processor to operate with the at least one display device and the at least one input device, for a play of a game, to:

(a) select a starting playing card from a plurality of playing cards, each of the plurality of playing cards including at least two of a plurality of different symbols and at two of the plurality of playing cards each including at least one terminator, (b) select a draw playing card from the plurality of playing cards, (c) display the symbols and any terminators of the selected playing cards, (d) determine any awards based on any matching symbols between the selected playing cards, (e) if each of the selected playing cards include at least one corresponding terminator, cause a termination event to occur, and (f) if each of the selected playing cards do not include at least one corresponding terminator:

(i) discard the selected playing card, (ii) reclassify the selected draw playing card as another starting playing card, (iii) select another draw playing card from the plurality of playing cards, (iv) display the symbols and any terminators of the draw playing cards, and (v) repeat (d) to (f) at least once.

2. The gaming system of claim 1, wherein when executed by the at least one processor, the plurality of instructions cause the at least one processor to determine any awards at least partially based on a quantity of matches that occur between the selected playing cards.

3. The gaming system of claim 2, wherein if at least one of the selected playing cards includes a plurality of one of the symbols and said symbol occurs on each of the selected playing cards, the award is at least partially based on the plurality of said one of the symbols included on at least one of the selected playing cards.

4. The gaming system of claim 1, wherein a first quantity of a first matching symbol between the selected playing cards is associated with a first award and the first quantity of a second, different matching symbol between the selected playing cards is associated with a second, different award.

5. The gaming system of claim 1, wherein at least one matching symbol occurs between any two of the plurality of playing cards.

6. The gaming system of claim 1, wherein each of the playing cards of the plurality of playing cards include a different combination of at least two of the symbols and any terminators.

7. The gaming system of claim 1, wherein when executed by the at least one processor, the plurality of instructions cause the at least one processor to enable a player to select the draw playing card from the plurality of playing cards.

8. The gaming system of claim 1, wherein when executed by the at least one processor, the plurality of instructions cause the at least one processor to enable a player to select the draw playing card from a randomly selected subset of the plurality of playing cards.

9. The gaming system of claim 1, wherein when executed by the at least one processor, the plurality of instructions cause the at least one processor to determine if the plurality of playing cards includes at least one previously unselected playing card and if each of the selected playing cards do not include at least one terminator and the plurality of playing cards includes at least one previously unselected playing cards, repeat (d) to (f) at least once.

10. The gaming system of claim 1, wherein when executed by the at least one processor, the plurality of instructions cause the at least one processor to enable a player to select a plurality of draw playing cards from the plurality of playing cards.

11. The gaming system of claim 10, wherein when executed by the at least one processor, the plurality of instructions cause the at least one processor to select a plurality of starting playing cards from the plurality of playing cards.

12. A method of operating a gaming system, for a play of a game, said method comprising:

(a) causing at least one processor to execute a plurality of instructions to select a starting playing card from a plurality of playing cards, each of the plurality of playing cards including at least two of a plurality of different symbols and at two of the plurality of playing cards each including at least one terminator;

(b) causing the at least one processor to execute the plurality of instructions to select a draw playing card from the plurality of playing cards;

(c) causing at least one display device to display the symbols and any terminators of the selected playing cards;

(d) causing the at least one processor to execute the plurality of instructions to determine any awards based on any matching symbols between the selected playing cards;

(e) if each of the selected playing cards include at least one corresponding terminator, causing the at least one processor to execute the plurality of instructions to cause a termination event to occur; and (f) if each of the selected playing cards do not include at least one corresponding terminator:

(i) causing the at least one processor to execute the plurality of instructions to discard the selected playing card, (ii) causing the at least one processor to execute the plurality of instructions to reclassify the selected draw playing card as another starting playing card, (iii) causing the at least one processor to execute the plurality of instructions to select another draw playing card from the plurality of playing cards, (iv) causing the at least one display device to display the symbols and any terminators of the draw playing cards, and (v) repeating (d) to (f) at least once.

13. The method of claim 12, which includes causing the at least one processor to execute the plurality of instructions to determine any awards at least partially based on a quantity of matches that occur between the selected playing cards.

14. The method of claim 13, wherein if at least one of the selected playing cards includes a plurality of one of the symbols and said symbol occurs on each of the selected playing cards, the award is at least partially based on the plurality of said one of the symbols included on at least one of the selected playing cards.

15. The method of claim 12, wherein a first quantity of a first matching symbol between the selected playing cards is associated with a first award and the first quantity of a second, different matching symbol between the selected playing cards is associated with a second, different award.

16. The method of claim 12, wherein at least one matching symbol occurs between any two of the plurality of playing cards.

17. The method of claim 12, wherein each of the playing cards of the plurality of playing cards include a different combination of at least two of the symbols and any terminators.

18. The method of claim 12, which includes enabling a player to select the draw playing card from the plurality of playing cards.

19. The method of claim 12, which includes enabling a player to select the draw playing card from a randomly selected subset of the plurality of playing cards.

20. The method of claim 12, which includes causing the at least one processor to execute the plurality of instructions to determine if the plurality of playing cards includes at least one previously unselected playing card and if each of the selected playing cards do not include at least one terminator and the plurality of playing cards includes at least one previously unselected playing cards, repeating (d) to (f) at least once.

21. The method of claim 12, which includes enabling a player to select a plurality of draw playing cards from the plurality of playing cards.

22. The method of claim 21, which includes causing the at least one processor to execute the plurality of instructions to select a plurality of starting playing cards from the plurality of playing cards.

23. The method of claim 12, which is provided through a data network.

24. The method of claim 23, wherein the data network is the internet.

* * * * *